US010555563B2

(12) United States Patent
Treyger

(10) Patent No.: US 10,555,563 B2
(45) Date of Patent: Feb. 11, 2020

(54) HYBRID APPAREL AND METHOD OF TRANSFORMING SAME INTO OTHER GARMENT TYPES

(71) Applicant: Liliya Treyger, Staten Island, NY (US)

(72) Inventor: Liliya Treyger, Staten Island, NY (US)

( * ) Notice: Subject to any disclaimer, the term of this patent is extended or adjusted under 35 U.S.C. 154(b) by 148 days.

(21) Appl. No.: 15/350,090

(22) Filed: Nov. 13, 2016

(65) Prior Publication Data

US 2017/0135421 A1 May 18, 2017

Related U.S. Application Data

(60) Provisional application No. 62/255,551, filed on Nov. 16, 2015.

(51) Int. Cl.

| | |
|---|---|
| ***A41D 15/04*** | (2006.01) |
| ***A41D 15/00*** | (2006.01) |
| ***A41D 1/04*** | (2006.01) |
| ***A41D 27/10*** | (2006.01) |
| ***A41D 23/00*** | (2006.01) |

(52) U.S. Cl.

CPC ..... *A41D 1/04* (2013.01); *A41D 15/00* (2013.01); *A41D 23/00* (2013.01); *A41D 27/10* (2013.01); *A41D 15/007* (2013.01); *A41D 2300/324* (2013.01); *A41D 2400/424* (2013.01)

(58) Field of Classification Search

CPC ..... A41D 15/04; A41D 15/00; A41D 27/10; A41D 1/00; A41D 1/04; A41D 3/00; A41D 13/08; A41D 13/0512; A41D 2023/004; A41D 15/005; A41D 15/02; A41D 27/00

See application file for complete search history.

(56) References Cited

U.S. PATENT DOCUMENTS

| | | | | | |
|---|---|---|---|---|---|
| 1,284,536 | A | * | 11/1918 | Yaeger | A41D 13/08 2/59 |
| 1,285,917 | A | * | 11/1918 | Smith | A41D 1/04 2/158 |
| 2,099,431 | A | * | 11/1937 | Reeb | A41D 27/10 2/126 |
| 2,237,368 | A | * | 4/1941 | Seitzman | A41D 15/00 2/91 |
| 2,326,422 | A | * | 8/1943 | Weisberger | A41D 13/08 2/59 |
| 2,382,396 | A | * | 8/1945 | Carlu | A41D 5/00 2/126 |
| 2,510,720 | A | * | 6/1950 | Siegel | A41D 23/00 2/65 |
| 2,670,470 | A | * | 3/1954 | Manheim | A41D 15/04 2/69.5 |
| 2,804,626 | A | * | 9/1957 | Rossiter | A41D 23/00 2/207 |
| 3,036,450 | A | * | 5/1962 | Holder | A42B 1/045 2/206 |

(Continued)

*Primary Examiner* — Robert H Muromoto, Jr.

(74) *Attorney, Agent, or Firm* — Mestechkin Law Group P.C.

(57) ABSTRACT

A multipurpose customizable garment designed to be transformed from the form of arm-wear into other types of garments. Specifically, the hybrid garment can be converted from a detachable sleeve to a scarf, vest, and a variety of neck-wear, leg-wear, and clothing tops by selective use of a plurality of fasteners which enable the wearer to vary the size and appearance of the garment.

16 Claims, 25 Drawing Sheets

(56) References Cited

U.S. PATENT DOCUMENTS 3,088,119 A * 5/1963 Grant ..... A41D 23/00 2/130
3,286,276 A * 11/1966 Calisch ..... A41D 23/00 2/207
3,310,052 A * 3/1967 Ward, Jr. ..... A41C 1/04 450/97
4,055,853 A * 11/1977 Argento ..... A41D 3/00 2/247
4,347,629 A * 9/1982 Itoi ..... A41D 3/00 2/108
4,404,688 A * 9/1983 Knight ..... A41D 23/00 2/203
4,559,647 A * 12/1985 Smith ..... A41D 15/007 2/158
4,570,267 A * 2/1986 Appel ..... A41B 9/06 2/91
4,654,897 A * 4/1987 Rosaen ..... A41D 23/00 2/207
4,706,304 A * 11/1987 Jones ..... A41D 1/04 2/91
4,977,622 A * 12/1990 Schley ..... A41D 13/12 2/114
5,115,517 A * 5/1992 Ferguson ..... A42B 1/045 2/171
5,131,096 A * 7/1992 Olson ..... A41D 11/00 2/69
5,226,193 A * 7/1993 Chen ..... A41B 13/06 2/69
D364,722 S * 12/1995 Kallonakis ..... D2/502
5,673,836 A * 10/1997 Bush ..... A41D 13/00 2/94
5,774,892 A * 7/1998 Tisdale ..... A41D 1/06 2/115
5,815,833 A * 10/1998 Kuo ..... A41D 15/04 2/69.5
5,867,835 A * 2/1999 Dabbieri ..... A41D 23/00 2/171
5,918,312 A * 7/1999 Craren ..... A41D 13/00 2/102
5,996,121 A * 12/1999 Harris ..... A41D 15/04 2/108
6,047,404 A * 4/2000 Blanks, I ..... A41D 15/00 2/108
6,247,178 B1 * 6/2001 Bilda ..... A41B 13/06 2/126
D448,540 S * 10/2001 Smith ..... D2/502
6,385,775 B1 * 5/2002 Komjati ..... A41D 15/04 2/86
6,665,876 B1 * 12/2003 Newman ..... A41D 13/08 2/207
6,971,566 B1 * 12/2005 Sartena ..... A45F 3/02 2/122
7,231,670 B2 * 6/2007 Chang ..... A41D 23/00 2/207
7,290,293 B2 * 11/2007 Kanitz ..... A41D 23/00 2/172
D565,277 S * 4/2008 Gibson ..... D2/600
D569,079 S * 5/2008 Whong ..... D2/502
7,392,549 B1 * 7/2008 Barber ..... A41D 13/0012 2/269
D575,936 S * 9/2008 Fenderson ..... D2/864
7,591,025 B2 * 9/2009 McGhee ..... A42B 1/041 2/202
7,908,669 B2 * 3/2011 Amson ..... A41D 27/12 2/207
D639,024 S * 6/2011 Benderradji ..... D2/501
8,006,318 B2 * 8/2011 Gallo ..... A41D 23/00 2/207
D646,468 S * 10/2011 Arrindell ..... D2/858
D649,742 S * 12/2011 Myrick ..... D2/502
D654,247 S * 2/2012 Osbourne ..... D2/702
8,251,933 B2 * 8/2012 Farrow ..... A61H 9/005 602/13
D677,448 S * 3/2013 Bazile ..... D2/728
8,479,315 B2 * 7/2013 Kelling ..... A41D 15/04 2/69
8,505,117 B2 * 8/2013 Park ..... A41D 23/00 2/202
9,009,866 B2 * 4/2015 Blakely ..... A41B 7/04 2/124
9,055,775 B2 * 6/2015 Taul ..... A41D 23/00
D737,019 S * 8/2015 Jensen ..... D2/502
9,149,078 B1 * 10/2015 Curtin ..... A41D 23/00
9,226,532 B2 * 1/2016 Orozco ..... A41D 11/00
9,723,882 B2 * 8/2017 Reuben ..... A41D 15/04
9,826,787 B2 * 11/2017 Wu ..... A41D 13/11
2005/0164598 A1 * 7/2005 Kelsey ..... A63H 3/52 446/296
2006/0137072 A1 * 6/2006 Visco ..... A41D 15/04 2/127
2007/0179421 A1 * 8/2007 Farrow ..... A61H 9/005 602/75
2009/0000005 A1 * 1/2009 Amson ..... A41D 23/00 2/48
2009/0320175 A1 * 12/2009 Shih ..... A41D 15/00 2/69
2010/0199399 A1 * 8/2010 Garza ..... A41D 15/002 2/24
2010/0281601 A1 * 11/2010 Clarke ..... A41D 1/08 2/236
2011/0126340 A1 * 6/2011 Wu ..... A41D 13/11 2/88
2012/0079644 A1 * 4/2012 Benderradji ..... A41D 23/00 2/207
2013/0198934 A1 * 8/2013 Marquez ..... A41D 23/00 2/171
2014/0115763 A1 * 5/2014 Orozco ..... A41D 11/00 2/455
2015/0071978 A1 * 3/2015 Chang ..... A61N 2/06 424/402
2016/0050994 A1 * 2/2016 Bushby ..... A41D 27/10 2/243.1
2016/0165975 A1 * 6/2016 Reuben ..... A41D 15/04 2/69.5
2017/0044695 A1 * 2/2017 Hays ..... D02J 1/00
2017/0145596 A1 * 5/2017 Hays ..... B32B 5/026

* cited by examiner 820
115
120
108
112
108

820
110
108
120
116
112
108
115

820
110
108
115
120
108
116
112
108
120

900
110
108
115
120
102
112

900
115
116
310
320
108
110
120
102
312

900
120
108
102

900
310
320
312
102
112
115
120

HYBRID APPAREL AND METHOD OF TRANSFORMING SAME INTO OTHER GARMENT TYPES

CROSS-REFERENCES TO RELATED APPLICATIONS

This application claims the benefit of U.S. Provisional Patent Application No. 62/255,551 entitled "Armwear and Method of Transforming Same into a Neckwear" filed Nov. 16, 2015, the entire disclosure of which is incorporated herein by reference.

BACKGROUND

Field of the Invention

The present invention is related generally to improvements in the field of wearable hybrid apparel. More specifically, the present invention provides customizable arm-wear and method for transforming same into neckwear or into one of several alternative garment types.

Description of Related Art

Although there are currently a number of different types of wearable hybrid apparel, few of them are designed with convenience in mind and each of them has certain disadvantages. For example, traditional wearable hybrid apparel does not provide for the additional uses or reconfigurations of detachable parts as an alternative type of wear, thereby necessitating storage of the removed parts of the apparel. In one example, traditional scarves typically cannot be used as any other form or type of wear. Also, while there are various types of apparel having sleeves, there are no types of apparel that allow its wearer to use the sleeves for any other purposes.

The design of currently available hybrid apparel suffers from a variety of other drawbacks as well. Due to the lack of customizability and versatility, the established designs are limited to either having detachable components and to serving one or two clothing functions without enabling the user to change the garment into one of a different type. This is because the current traditional hybrid apparel does not provide for modular, detachable, and reconfigurable elements which can serve different clothing purposes. Accordingly, the existing wearable hybrid apparel typically lacks versatility. Consequently, because this drawback significantly limits the variability of apparel, this results in narrow profit margins in highly competitive clothing industry. For the foregoing reasons, there is an ongoing need for versatile clothing designs that combine economy and ease of manufacture with ease and customizability of use and an aesthetically pleasing appearance. These and other features and advantages of the present invention will be explained and will become obvious to one skilled in the art through the summary of the invention that follows.

SUMMARY

The present invention is directed to an article of manufacture and a method of use relating thereto that meets the abovementioned needs and addresses the deficiencies noted above. Accordingly, it is an object of the present invention to provide a highly customizable and versatile article of wearable apparel that can be configured and combined to a variety of alternative modular garments. Embodiments of the present invention are generally related to apparel having a pliable extended element with a plurality of interconnectable fasteners. In particular, embodiments of the present invention are directed to articles of wearable apparel the elements of which are either substantially flat or substantially tubular that are designed to transform into garments of a different type or category by selectively attaching one portion of the element to another or by attaching several wearable apparel elements to each other to result in a combination that forms a garment that is of a different type than that of the article as originally configured.

A preferred embodiment of the invention provides an article of apparel having detachable sleeves, where each detachable sleeve is manufactured using a flat, pliable, and substantially rectangular or, alternatively, a substantially tubular element. The embodiment with the rectangular element has a first end and a second end in addition to a top edge and a bottom edge, and further has first and second opposite exterior surfaces, each being bounded by the first and second ends and top and bottom edges. The embodiment with the tubular element has inner and outer circumferential surfaces bounded by a top and bottom edge.

The embodiments described herein along with others permit a user or wearer to easily configure and transform an article of apparel of one type into a garment of another type that is usually worn in a different manner or for different purposes by a wearer. The embodiments of the present invention also provide for unprecedented versatility in the designs of the garments that can be created or configured therefrom.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

These and other features, aspects, functions, and advantages of the present invention will become better understood with respect to the following description, appended claims, and accompanying drawings where:

FIG. 25 comprises a side view of an alternative combination of customized garment configurations, being worn by a wearer in accordance with an embodiment of the present invention.

DETAILED SPECIFICATION

Figure 1:
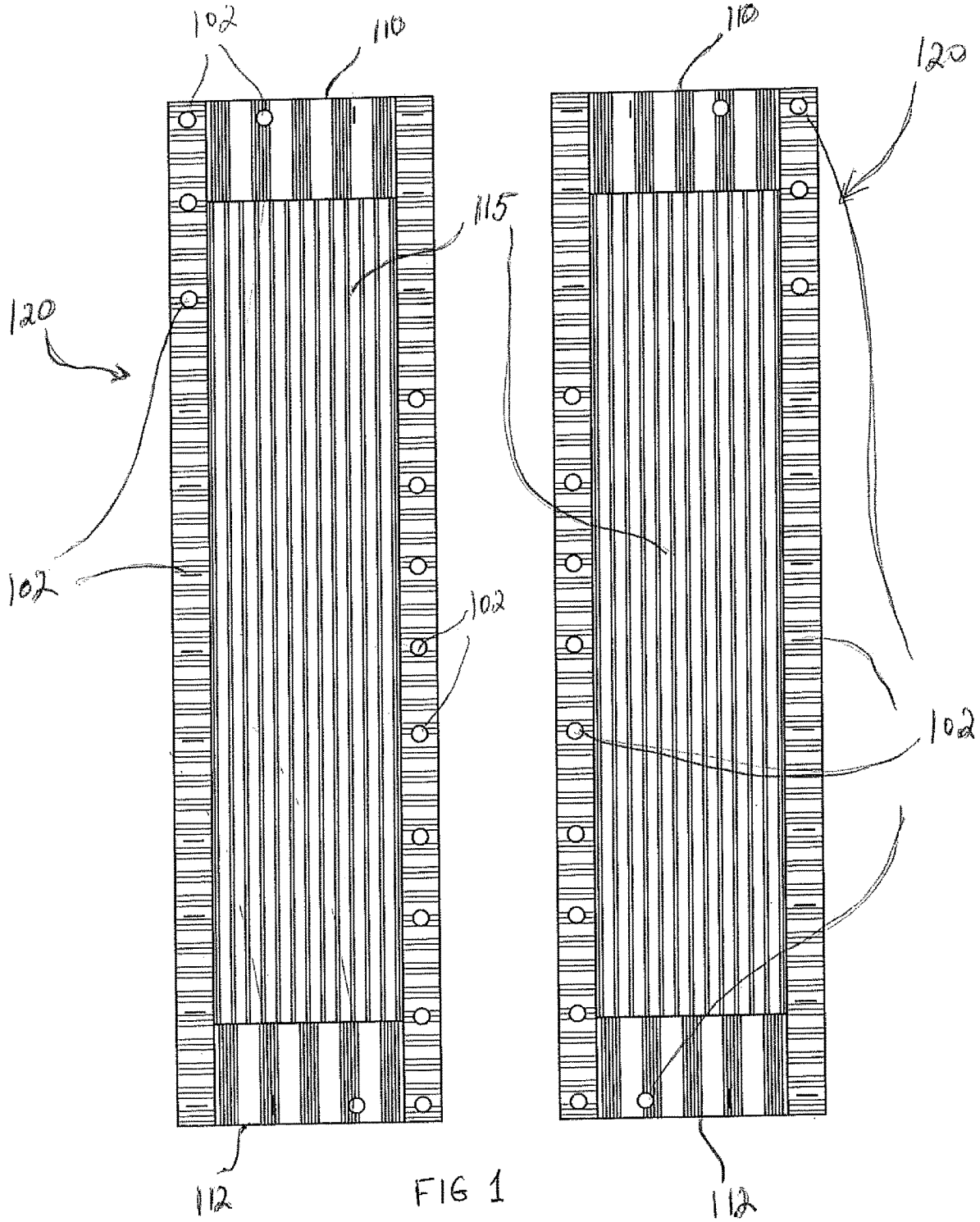
FIG. 1 is a planar view illustrating a surface of each one of a pair of customizable sleeves, in accordance with an embodiment of the present invention.

In the Summary above, in the Detailed Specification, the Claims below, and in the accompanying drawings, reference is made to particular features, including method steps, of the invention. It is to be understood that the disclosure of the invention in this specification includes a plurality of combinations of such particular features. For example, where a particular feature is disclosed in the context of a claim, that feature can also be used to the extent possible, in combination with and/or in the context of other particular aspects and embodiments of the invention and in the invention generally.

The term "comprises" and grammatical equivalents thereof are used herein to mean that other components, ingredients, steps, etc. are optionally present. For example, an article "comprising" (or "which comprises") components A, B, and C can consist of (i.e. contain only) components A, B, and C or can contain not only components A, B, and C also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context exclude that possibility).

The term "at least" followed by a number is used here into the note the start of a range beginning with that number (which may be a range having an upper limit or no upper limit, depending on the variable being defined). For example, "at, least one" means one or more than one. The term "at most" followed by a number is used here into the note the end of a range ending with that number (which may be a range having 1 or 0 as its lower limit, or, a range having no lower limit, depending upon the variable being defined). For example "at most 4" means four or less than 4, and "at most 40%" means 40% or less than 40%. When, in the specification, a range is given as "(a first number) to (a second number)" or "(a first number)–(a second number)," this means a range whose lower limit is the first number and whose upper limit is the second number. For example, 25 to 100 mm means a range whose lower limit is 25 mm, and whose upper limit is 100 mm.

The terms "garment", "apparel", and "clothing" may be used interchangeably herein. It is to be understood that each of these terms may refer to an item that is comprised of one or more elements which are also referred to by one of these terms. For the sake of clarity, as used herein, a "garment" may comprise one or more items of "apparel" and vice versa. Similarly, as used herein, an item of "clothing" may comprise one or more articles of "apparel" and vice versa.

Embodiments of the present invention encompass hybrid apparel and garments equipped with a plurality of fasteners. More specifically, embodiments of the present invention are directed to articles of clothing which designed for convenient reconfiguration and combination with other articles of clothing. Unique modular aspects of the present invention provide for wearable garments to be formed by combining elements of apparel each of which are independently wearable as distinct articles of clothing. Further, as described in more detail below, embodiments of the present invention are directed to hybrid apparel articles which are customizable in the sense that they can be reconfigured from one type of garment into another type of garment through the selective use of fasteners.

A preferred embodiment of the invention provides an article of apparel having detachable sleeves, where each detachable sleeve is manufactured using a flat, pliable, substantially rectangular element in one variation, or a substantially tubular element in another variation. Each rectangular element is equipped with fasteners. A first plurality of fasteners are attached to the first surface of the rectangular element proximate to its first end, and second plurality fasteners attached to the second surface of the rectangular element proximate to its second end. The first and second ends of the rectangular element are securely fastenable to each other at the first and second fasteners. The first and second fasteners are positioned such that when the first end is attached to the second end, the rectangular element forms a tube having inner and outer circumferential surfaces provided by the first and second exterior surfaces of the rectangular element. The tube is dimensioned to fit around a wearer's arm and can function as a detachable sleeve that can be connected to another garment or worn independently.

Figure 2:
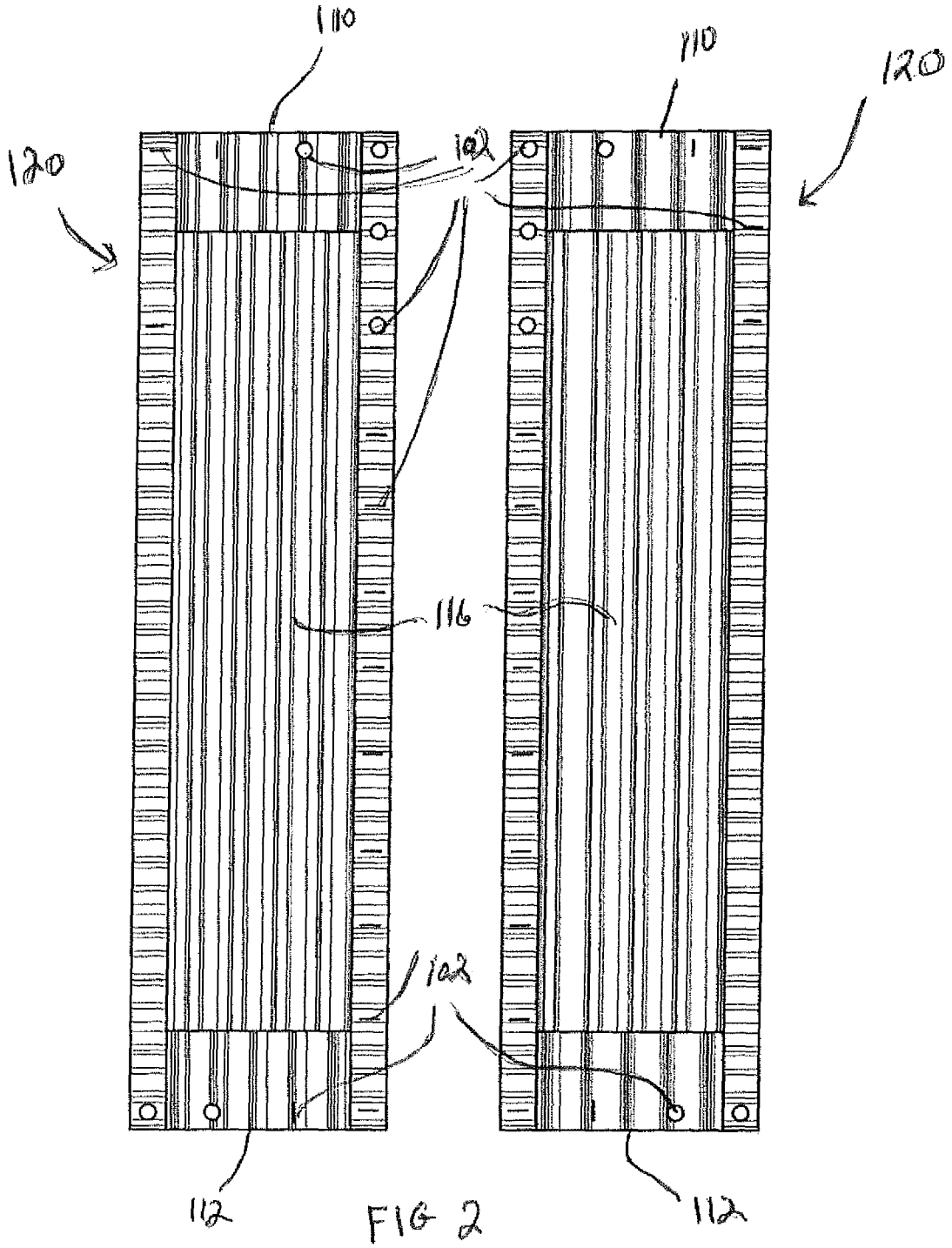
FIG. 2 is a planar view illustrating the obverse surface of each one of the pair of customizable sleeves shown in FIG. 1, in accordance with an embodiment of the present invention.

Turning now to FIGS. 1-2, in one embodiment, the rectangular element 120 has a first end and a second end and a top edge 110 and a bottom edge 112, and further has a first exterior surface 115 and a second exterior surface 116 on the reverse side of the element 120, with both surfaces bounded by the first and second ends and the top and bottom edges. The depicted element 120 of the embodiment is equipped with a plurality of fasteners 102 dispersed on the surfaces thereof. The fasteners 102 may be any fasteners suitable for removably connecting one part of the element 120 to another part of the element 120 or connecting the element 120 to another article of apparel and are therefore not limited in size, shape, or function to those shown in the accompanying drawings. Preferably, the fasteners 102 are positioned in proximity to the ends of the rectangular element 120 as well as to the top edge 110 and bottom edge 112 of the article of apparel's element 120. The plurality of fasteners 102 may, but are not required to, be complementary to one another and may also be of disparate types permitting them to connect to other garment fasteners.

As can be seen in FIGS. 1-2, sets of complementary fasteners 102 are disposed at the ends of the rectangular element 120 longitudinally along each of the pair of its elongated opposite sides. As the set of fasteners 102 along one of the elongated ends of the rectangular element 120 are attached to the set of fasteners 102 along the other elongated end of the element 102, the element 102 is curved into a tubular shape. Thus, the article of apparel forms a detachable sleeve that can be attached to another sleeveless or short-sleeved article of apparel.

In the preferred embodiment, a third set of the plurality of fasteners 102 is attached to the first surface 115 of the rectangular element 120 proximate to its top edge 110, and a fourth set of the plurality fasteners 102 is attached to the second surface 116 of the rectangular element 120 proximate to its bottom edge 112. In such an embodiment, each removable sleeve may be removably fastenable to a sleeveless or short-sleeved article of apparel using the third set of fasteners 102 or the fourth set of fasteners 102. It is to be understood that the sleeveless or short-sleeved article of apparel must include suitable fasteners for attaching the removable sleeves using the third set of fasteners 102 or fourth set of fasteners 102 of the removable sleeves. However, not all embodiments of the present invention need to have each of a first, second, third and fourth set of fasteners respectively positioned proximate to the first end, second end, top edge 110 and bottom edge 112.

Figure 3:
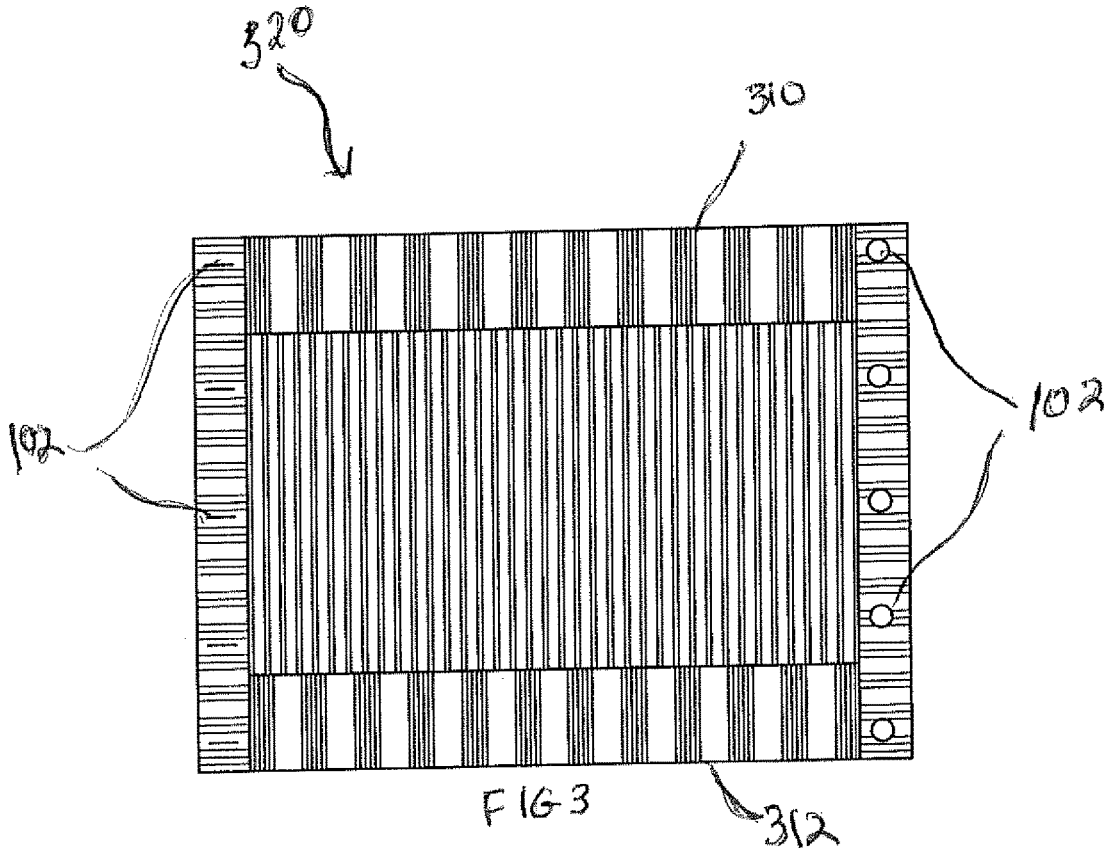
FIG. 3 is a planar view of a third customizable element in accordance with an embodiment of the present invention.
Figure 4A:
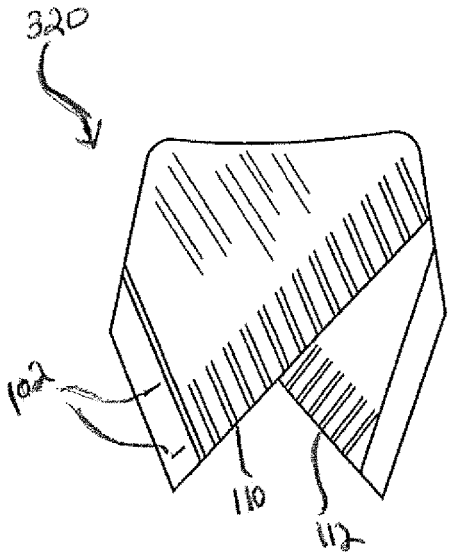
FIG. 4A is a front top plan views of a third customizable element configured into a neckwear handkerchief accessory.
Figure 4B:
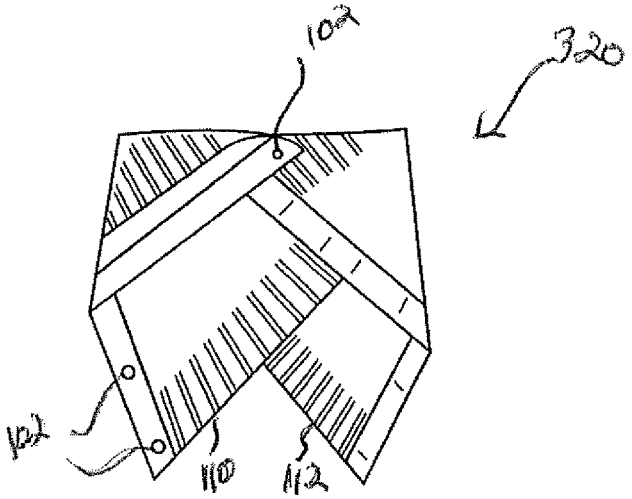
FIG. 4B is rear top plan view of a third customizable element configured into a neckwear handkerchief accessory.

For example, with respect to the third customizable element 320, shown in FIG. 3, fasteners 102 may be positioned solely along the sides of the element and not along its top edge 310 or bottom edge 312 as depicted in FIG. 3. Such an alternative arrangement of fasteners 102 and alternative dimensions of a rectangular element 320 can be formed into a handkerchief or handkerchief typically worn as a neckerchief. FIGS. 4A-4B show the third customizable element 320 of FIG. 3 reconfigured into a pocket-square handkerchief by folding it and connecting one fastener 102 from one side of the third customizable element 320 to another to securely hold its shape.

In the embodiment of the present invention with a tubular element, the tubular element has inner and outer circumferential surfaces bounded by a top edge 110 and bottom edge 112. In this embodiment the tubular element can be either knitted without a seam on a circular knitting machine or knitted as a rectangular element 120 and seamed/sewn into a tubular shape. Each tubular element is equipped with fasteners at top and bottom edges 110, 112. The tubular element is sized to fit around a wearer's arm and is suitable to function as a sleeve that can be worn independently or attached to another garment. Thus, this embodiment would function as a detachable sleeve analogously to the embodiment comprised of a rectangular element 120 and curved into a tubular shape via a selective mutual engagement of sets of fasteners 102 deployed along opposite ends of the element 120 as described above.

Figure 5:
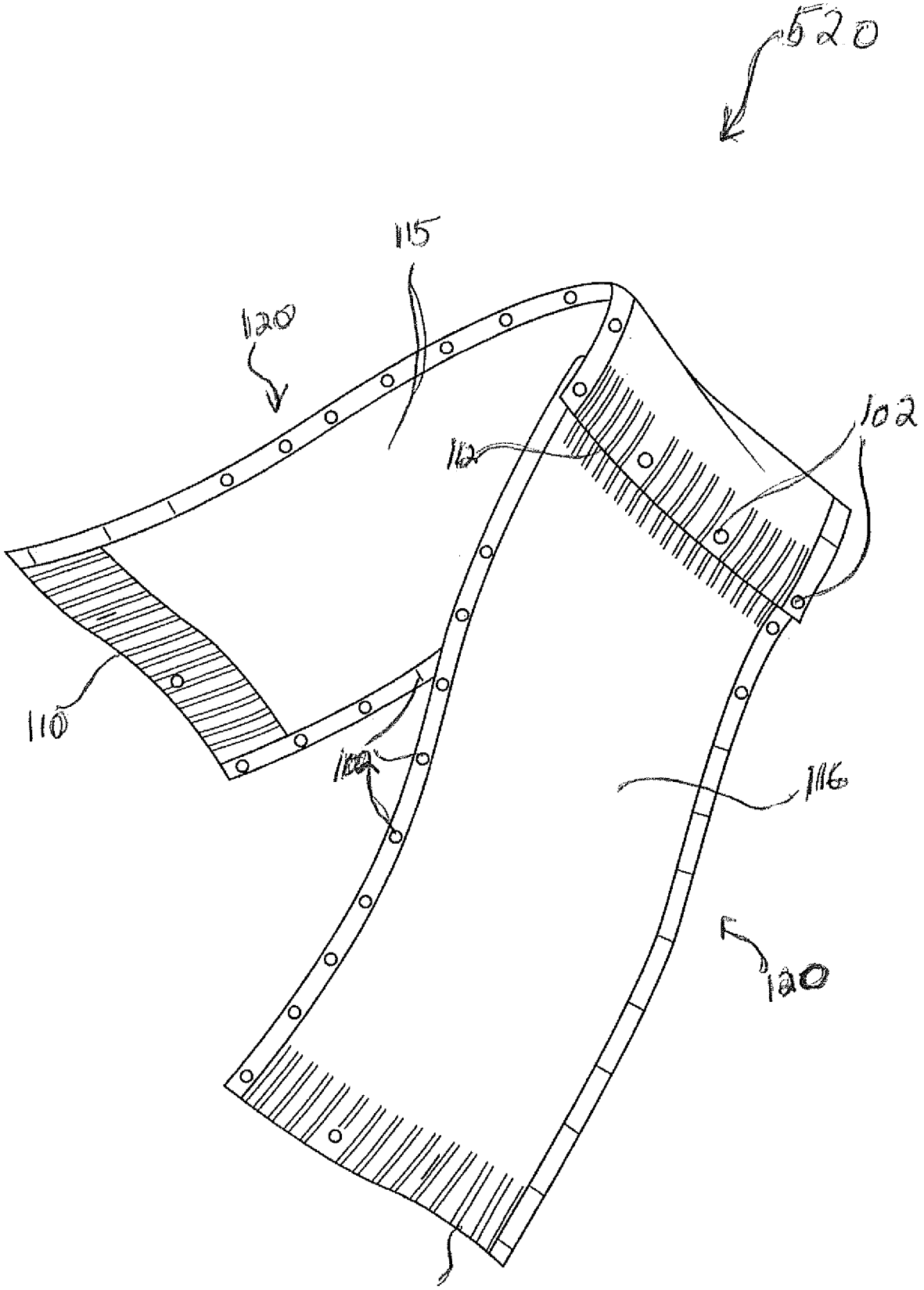
FIG. 5 is a perspective view depicting the combination of two customizable sleeves transformed into an embodiment suitable to be used as a scarf.

In another embodiment, the customizable sleeves embodied by either the rectangular-element or the tubular-element variations described previously can be effortlessly transformed into a scarf garment 520, as shown in FIG. 5. The transformation of the customizable sleeve into a scarf is achieved by performing two simple steps. In the first step, the first and second set of fasteners 102 of each detachable sleeve element 120 are unfastened such that the first and second ends of each detachable sleeve are no longer connected to each other and each removable sleeve is returned to its flat form. In the second step, as shown in FIG. 5 two rectangular elements 120 are positioned such that the fourth set of fasteners 102 on the bottom edge 112 of a first rectangular element 120 are attached to the third set of fasteners 102 on the top edge 110 of a second rectangular element, thereby forming a single elongated flat rectangular garment element 520 that may be used as a scarf. In accordance with the present embodiment the scarf type garment as worn by a wearer are shown in FIGS. 15, 18A, 24 and 25.

Accordingly, the customizable sleeves in their tubular-element embodiments are transformed into a scarf-type garment 520 in an analogous manner. Two customizable detachable sleeves, in their tubular-element embodiments, can be easily interconnected at a top edge 110 and bottom edge 112 such that the fourth set of fasteners 102 on the bottom edge 112 of a first tubular element are attached to the third set of fasteners 102 on the top edge 110 of a second tubular element, thereby forming a single elongated tubular element that may be used as a scarf or neckwear. It should be understood by one skilled in the art that a selective engagement of the aforementioned first, second, third, and fourth sets of fasteners can be used to form a variety of garment types and designs, many of which are described as follows.

Figure 6A:
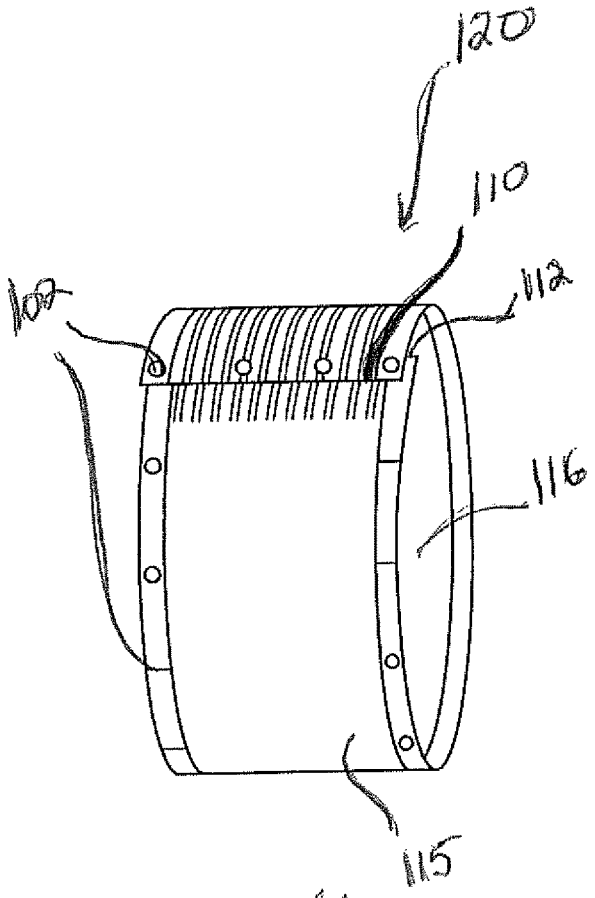
FIG. 6A is a perspective view of a singular customizable sleeve configured into a tubular shape suitable to serve as neckwear in accordance with an embodiment of the present invention.
Figure 6B:
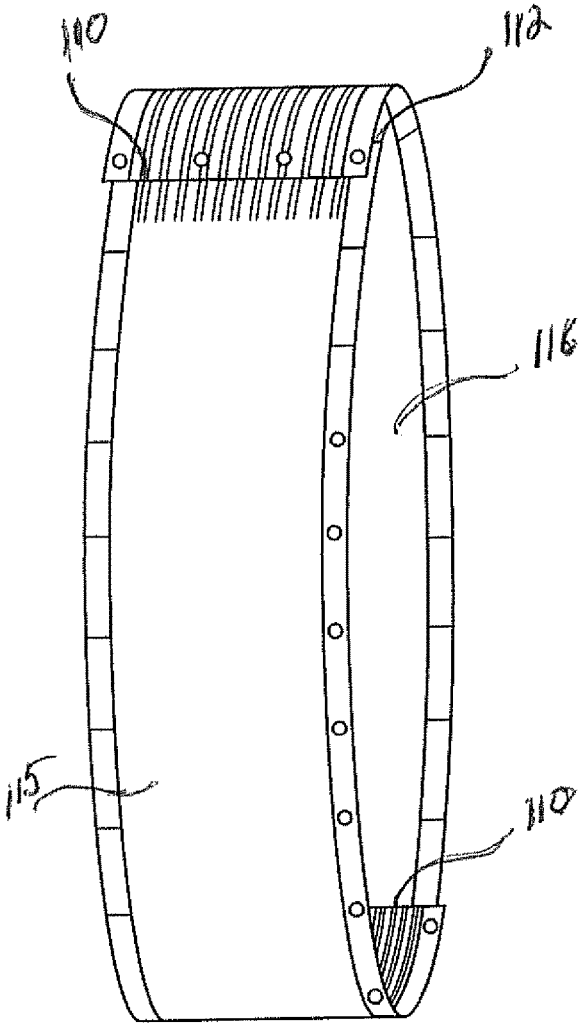
FIG. 6B is a perspective view of a combination of two mutually connected customizable sleeves forming a larger cylindrically shaped wearable apparel in accordance with an embodiment of the present invention.

FIGS. 6A-6B show the customizable sleeves in their flat configuration being transformed into a turtleneck-type or headband-type garment. Specifically, in FIG. 6A, the top 110 and bottom 112 edges of a single customizable sleeve 120 are securely fastenable to each other at the third and fourth sets of fasteners 102. The third and fourth sets of fasteners 102 are positioned such that when the top edge 110 is attached to the bottom edge 112, the single customizable sleeve forms a cylinder having inner and outer circumferential surfaces provided by the first exterior surface 115 and second exterior surface 116 of the single customizable sleeve 120. The cylinder is dimensioned to fit around a wearer's neck (i.e., turtleneck/collar) or head (i.e., headband).

In FIG. 6B, two customizable sleeves 120 are shown to be interconnected to form a cylinder of a larger diameter than that which can be made by using only a single customizable sleeve 120. In this instance, the third set of fasteners 102 at the top edge 110 of a first customizable sleeve 120 is engaged with a fourth set of fasteners 102 at the bottom edge 112 of a second customizable sleeve 120 and a fourth set of fasteners 102 at the bottom edge 112 of the first customizable sleeve 120 is engaged with the third set of fasteners 102 set at the top edge 110 of the second customizable sleeve 120. Thus, a cylindrical garment suitable to be worn as a belt, headband, or skirt is formed. It should be understood that the diameter or length of the cylindrically shaped garment can be modified by selectively engaging the fasteners 102 located further along either end of the rectangular element of a customizable sleeve instead of, or in addition to, the fasteners displaced at the top 110 and bottom 112 edges of the customizable sleeve 120.

Figure 24:
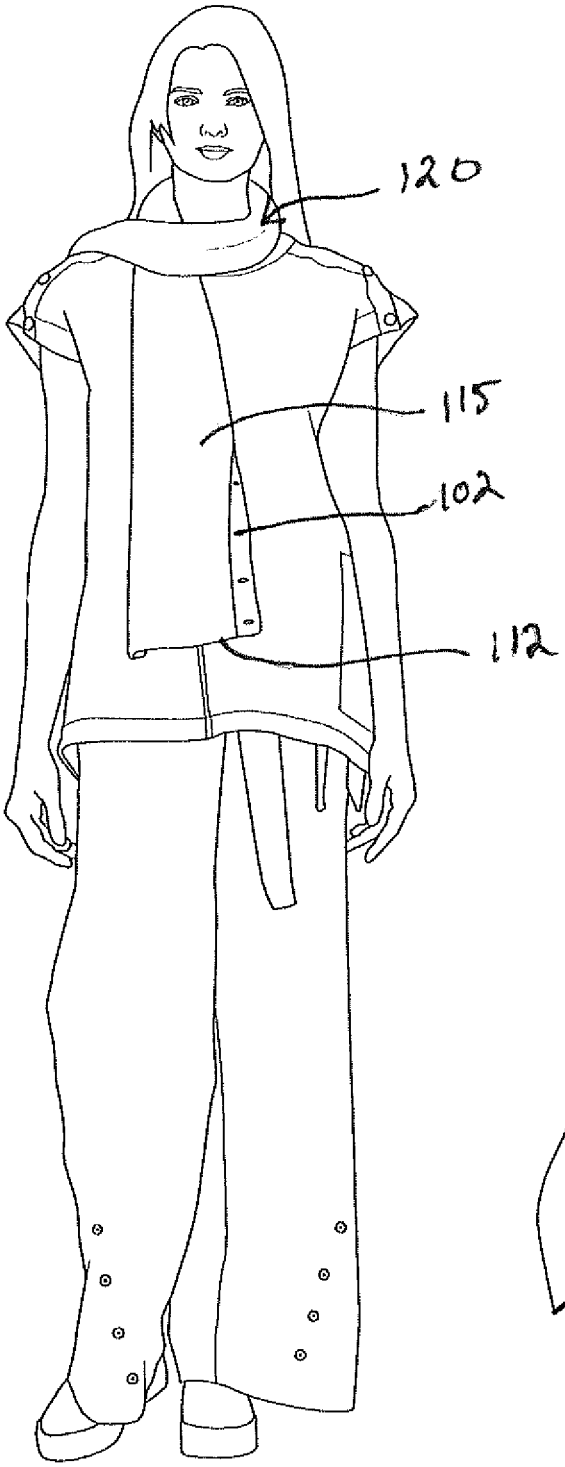
FIG. 24 comprises a perspective view of a combination of customized garment configurations with neckwear being worn by a wearer in accordance with an embodiment of the present invention.
Figure 26:
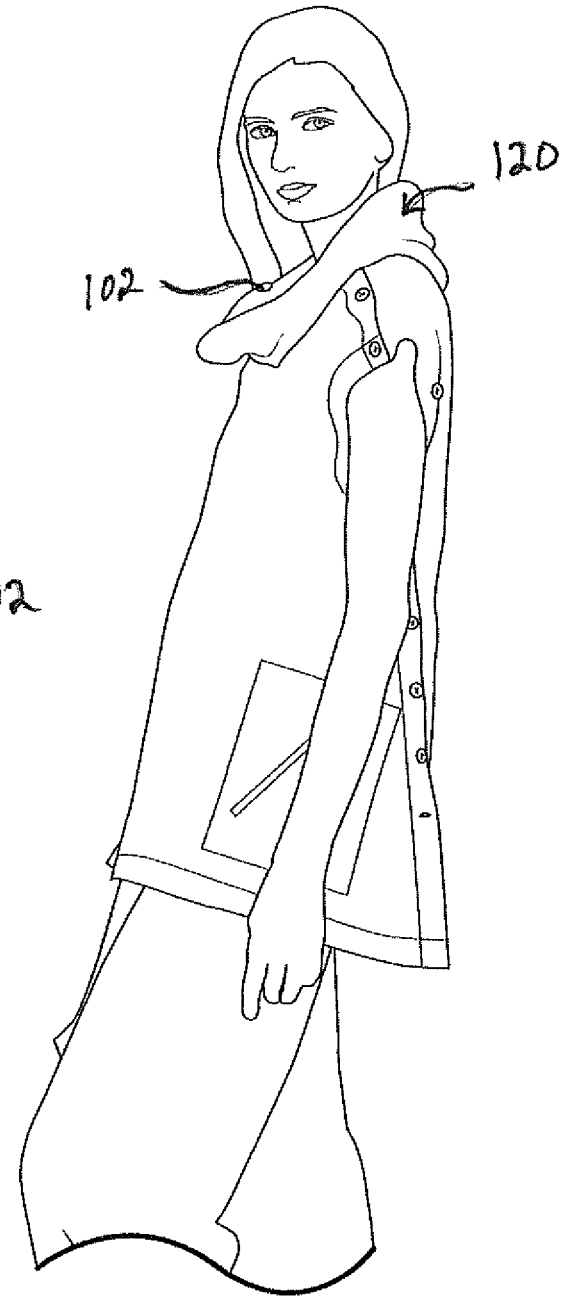
FIG. 26 comprises a side view of one other combination of customized garment configurations, being worn by a wearer in accordance with an embodiment of the present invention.
Figure 26:
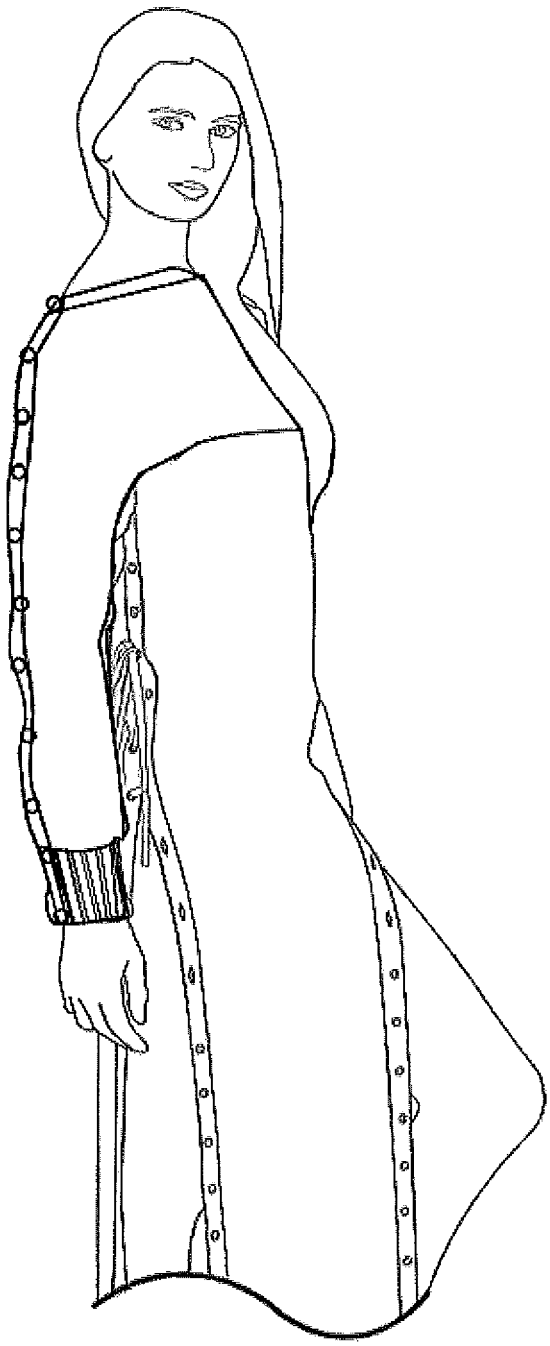

In an analogous manner, a tubular-element (seamless or seamed) variation of the present invention can also be transformed into a turtleneck-type or headband type garment. The top 110 and bottom 112 edge of the customizable sleeve in a tubular configuration are removably fastenable to each other at the third and fourth sets of fasteners 102. The third and fourth sets of fasteners 120 are positioned such that when the top edge 110 is attached to the bottom edge 112, the tubular element forms a toroidal shape having inner and outer toroidal surfaces both of which are provided by what was previously the interior and exterior surfaces of the tubular element prior to its edges being attached to each other. The tube is dimensioned to fit around a wearer's neck (i.e., turtleneck/collar) or head (i.e., headband). It should be understood that, since garments and articles of apparel are typically manufactured using non-rigid and non-resilient materials and fabrics, the tubular and toroidal elements of the embodiments of the invention described herein would most commonly be partially or wholly flattened when at rest. An example of how this configuration of the embodiment of the present invention would be worn is depicted in FIGS. 24-25.

As may be understood, in the various embodiments of the present invention, each of the surfaces of the customizable sleeves and the third customizable element respectively may be constructed from a different material. For example, with respect to the embodiments made from elements comprising a first and second surface, the first surface may be constructed from a different material from the second surface, or may have a different color or aesthetic appearance from the second surface. Also, in embodiments of the present invention comprising more than one customizable element of an article of apparel, each one of the customizable elements in its entirety may be constructed from a material that is different from that of another customizable element, or may have a different color or aesthetic appearance from that of another element.

It is to be understood that the modular element shapes of the customizable articles of apparel in accordance with the embodiments of the present invention are not limited just to the rectangular shapes described above but extend to other polygonal element shapes as well. Further, it should also be understood that the polygonal shapes described herein are approximations due to the possible natural deformations of the shapes of the stretchy and pliable wearable elements of fabric apparel.

For example, customizable detachable sleeves may be manufactured using a flat, pliable material having a form of a parallelogram. In this embodiment, in order to transform detachable sleeves, in the second step, described above, two parallelogrammical elements are positioned such that the first surface of the first parallelogrammical element "faces" the second surface of the second parallelogram form with the fourth set of fasteners 102 on the bottom edge 112 of a first parallelogram element are attached to the third set of fasteners 102 on the top edge 110 of a second parallelogrammical element, thereby forming a single elongated flat parallelogrammical element that may be used as a scarf.

Figure 7:
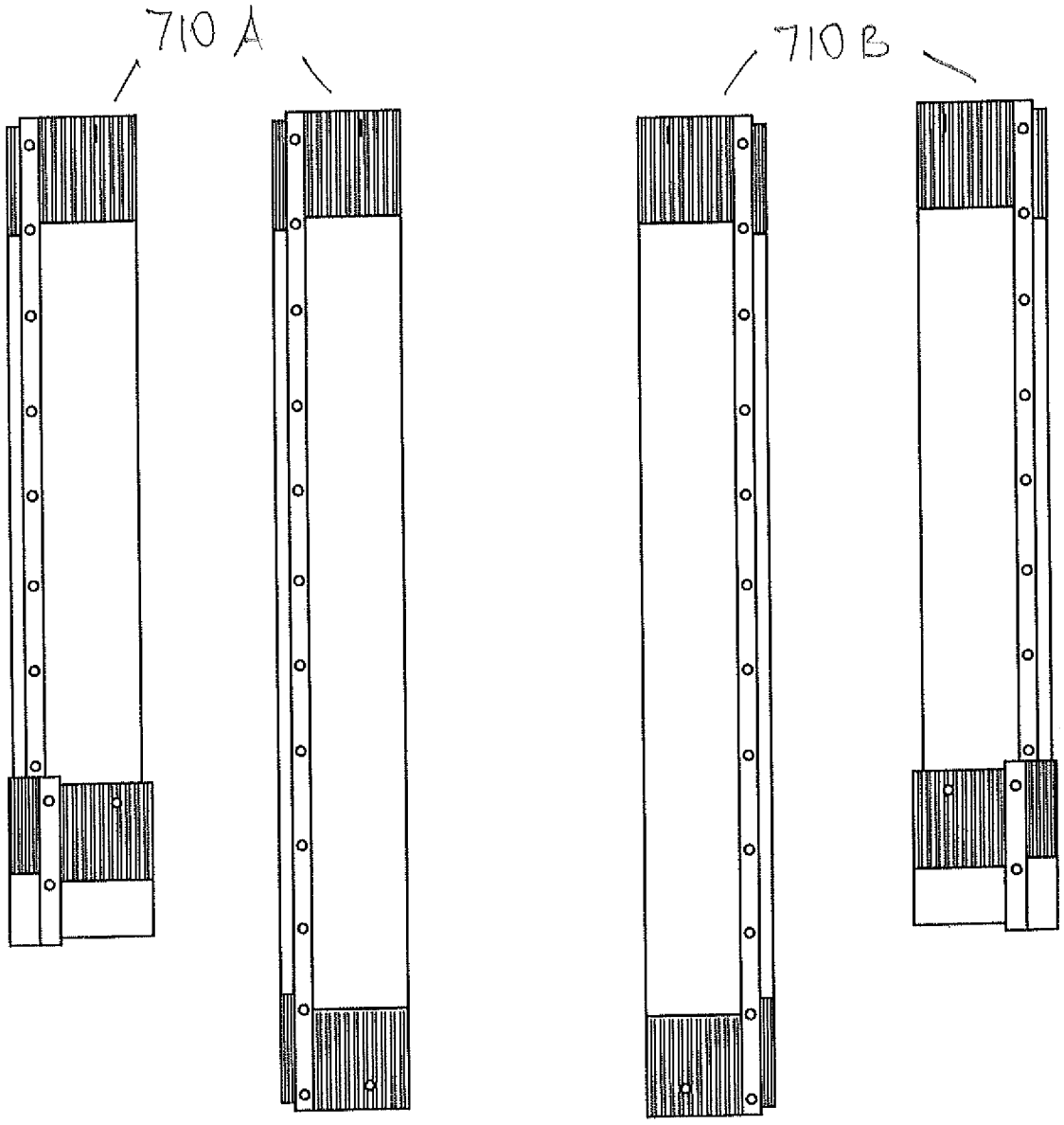
FIG. 7 is a planar view of customizable sleeves configured into a tubular form in accordance with an embodiment of the present invention.

FIG. 7 depicts a planar view of customizable detachable sleeves 710 configured into a tubular form, in accordance with an embodiment of the present invention. Specifically, FIG. 7 depicts two pairs 710A and 710B of detachable customizable sleeves in tubular configuration achieved by connecting the fasteners 102 of each customizable sleeve. Each pair of the customizable detachable sleeves is presented to illustrate one of the customizable detachable sleeves having one end in a rolled-up configuration to demonstrate the option for a wearer to shorten a sleeve if desired. A person skilled in the art will understand that detachable sleeves 710 represent tubular embodiment of detachable elements 120 shown in FIGS. 1-2.

FIGS. 8-26 depict a variety of embodiments of the present invention comprising combinations and configurations of the previously described embodiments and hybrid wearable apparel element types. In each of these figures the embodiment of the invention depicted is a result of a selective engagement of one set of fasteners to another set thereof located on one element of an item of apparel disclosed above, or a result of an engagement of fasteners of one element of a wearable apparel disclosed above to that of another element of wearable apparel disclosed above.

Figures 8A, 8B, 8C:
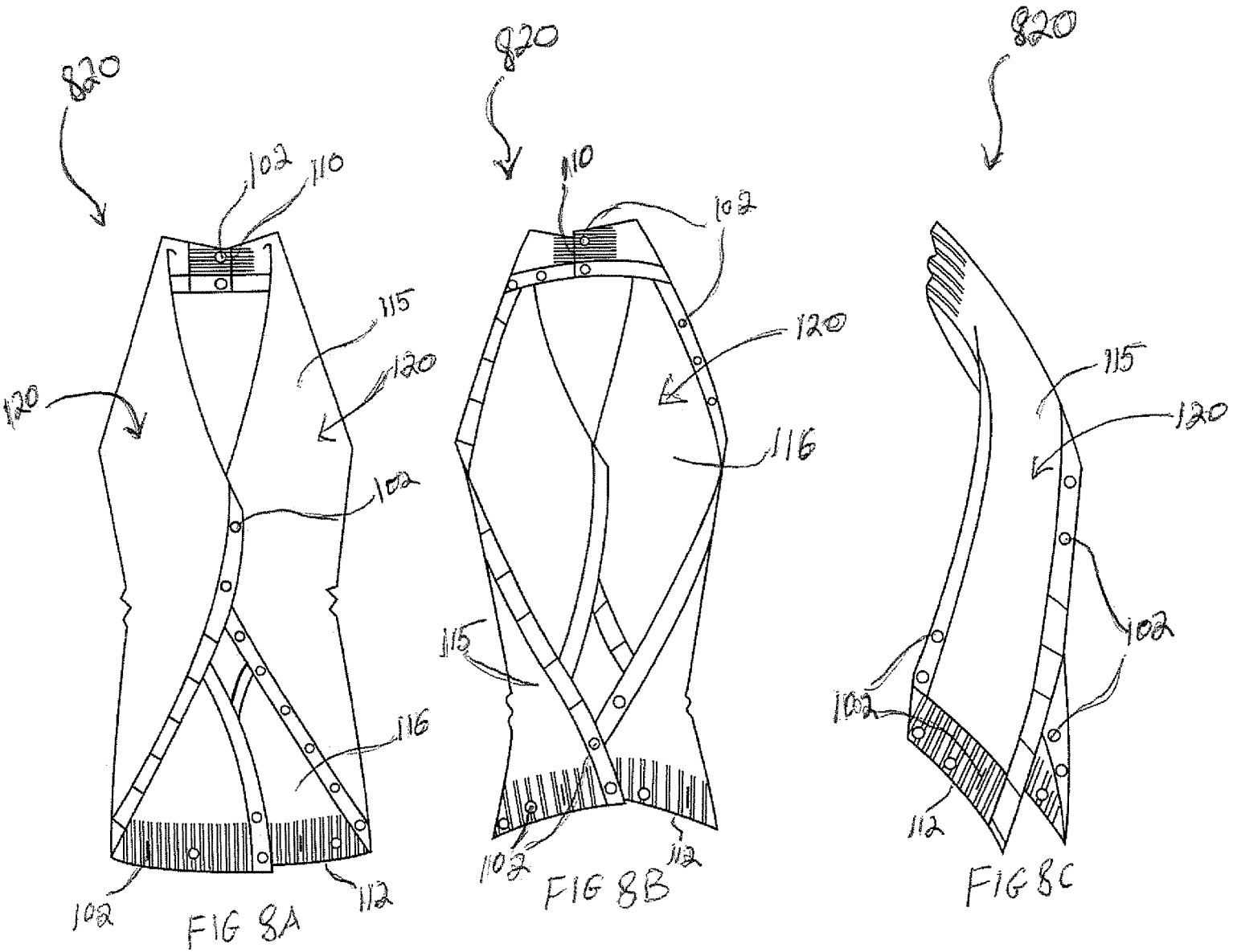
FIG. 8A comprises a front view of a pair of customizable sleeves converted into a backless top in accordance with an embodiment of the present invention.
FIG. 8B comprises a rear view of a pair of customizable sleeves converted into a backless top in accordance with an embodiment of the present invention.
FIG. 8C comprises side view of a pair of customizable sleeves converted into a backless top in accordance with an embodiment of the present invention.

In FIGS. 8A-8C an embodiment of the present invention is shown where two detachable customizable sleeves 120 of hybrid wearable apparel are attached to each other via fasteners 102 to form a sleeveless (e.g., vest-type) garment 820 that can also function as a backless top or halter-top. Fasteners 102 located proximate to the top edge 110 and bottom edge 112 as well as on a left and right side of one detachable customizable sleeve 120, are attached to corresponding fasteners 102 of another detachable customizable sleeve 102. The engagement of fasteners 102 proximate to top edge 110 creates a portion of the garment 820 configured to fit around the neck or a wearer. The engagement of fasteners 102 proximate to one side of one detachable customizable sleeve 120 to the fasteners 102 proximate to a corresponding side of the other detachable customizable sleeve 120 forms the front of the garment 820. Lastly, engagement of fasteners 102 positioned proximate to another side of one detachable customizable sleeve 120 to the fasteners 102 proximate to a corresponding side of the other detachable customizable sleeve 120 functions to create the back of the garment which would partially cover the back of a wearer when the garment is worn. The first surfaces 115 of each of the elements 120 and the second surfaces 116 of each of the elements 120 combine to form the interior and exterior surfaces of the garment 820 respectively.

Figures 9A, 9B, 9C, 9D:
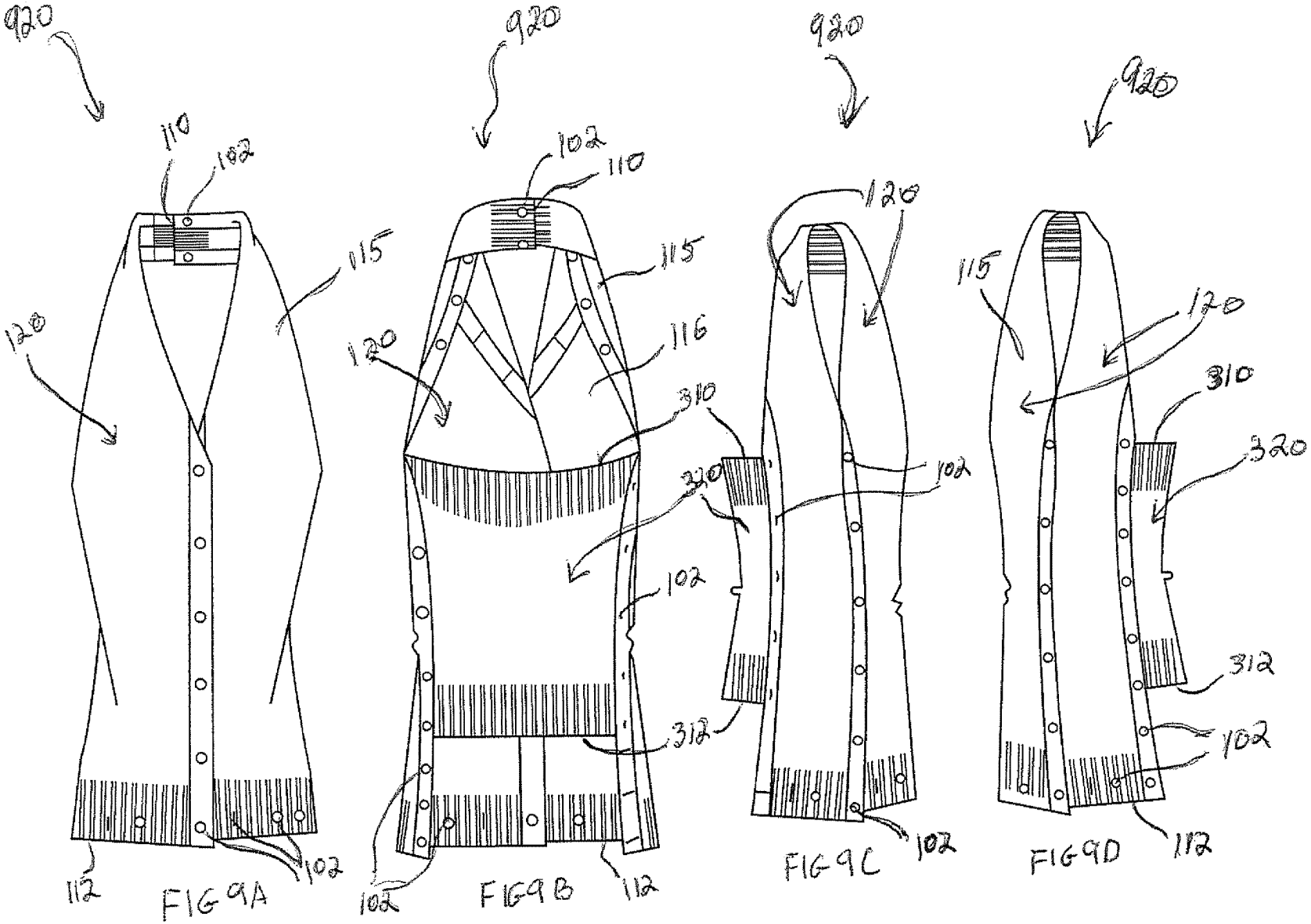
FIG. 9A comprises a front view of a combination of a pair of customizable sleeves and a third customizable element configured into a low-back top in accordance with an embodiment of the present invention.
FIG. 9B comprise a rear view of a combination of a pair of customizable sleeves and the third customizable element configured into a low-back top in accordance with an embodiment of the present invention.
FIG. 9C comprise a right-side view of a combination of a pair of customizable sleeves and the third customizable element configured into a low-back top in accordance with an embodiment of the present invention.
FIG. 9D comprise a left-side view of a combination of a pair of customizable sleeves and the third customizable element configured into a low-back top in accordance with an embodiment of the present invention.

In FIGS. 9A-8D another embodiment of the present invention is shown where two identical detachable customizable sleeves/armwear 120 and a third customizable element 320 of hybrid wearable apparel are attached to each other via fasteners 102 to form a garment halter top 920. Attaching a first end of the third customizable element 320 to a second end of one detachable customizable sleeve 120 and attaching a second end of third customizable element 320 to a first end of the other detachable customizable sleeve 120 forms the back of garment 920 via engagement of corresponding fasteners 102 disposed proximate to each respective end. Further attaching fasteners proximate to the top edge 110 of one detachable customizable sleeve 120 to corresponding fasteners of the other detachable customizable sleeve 120 forms the portion of the garment which is configured to fit around the neck of the wearer. Engagement of fasteners 102 disposed along the first end of one detachable customizable sleeve 120 to fasteners 102 disposed along the second end of the other detachable customizable sleeve 120 forms the front of the garment 920. Lastly, fasteners 102 disposed along the first end of each detachable customizable sleeve 120 near its top portion are engaged with fasteners 102 disposed along the second end of detachable customizable sleeve 120 near its top to form a tapered neck-line. The first surfaces 115 of each of the detachable customizable sleeves 120 and the second surfaces 116 of each of the detachable customizable sleeves 120 combine to form the interior and exterior surfaces of the garment 920 respectively. It should be understood that according to this embodiment of the present invention, through, the addition of the third customizable element 320 to the back of the vest-type garment 820, the garment 820 can be transformed into a low-back top garment 920 which can function as a shirt, dress, or blouse.

Figures 10A, 10B:
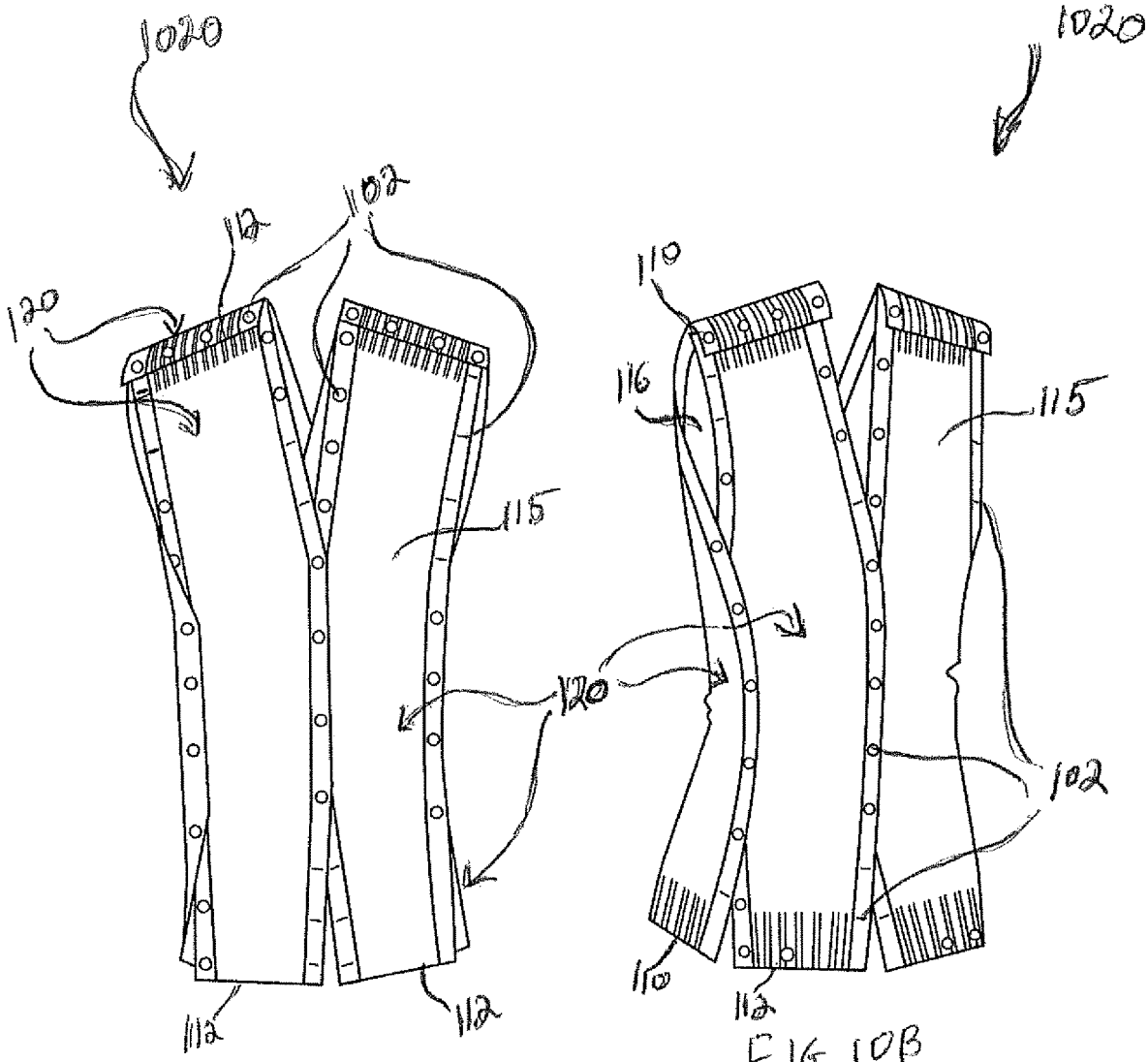
FIG. 10A comprises a front view of a combination of customizable sleeves configured into a sleeveless top in accordance with an embodiment of the present invention.
FIG. 10B comprises a perspective view of a combination of customizable sleeves configured into a sleeveless top in accordance with an embodiment of the present invention.
Figures 11A, 11B, 11C, 11D:
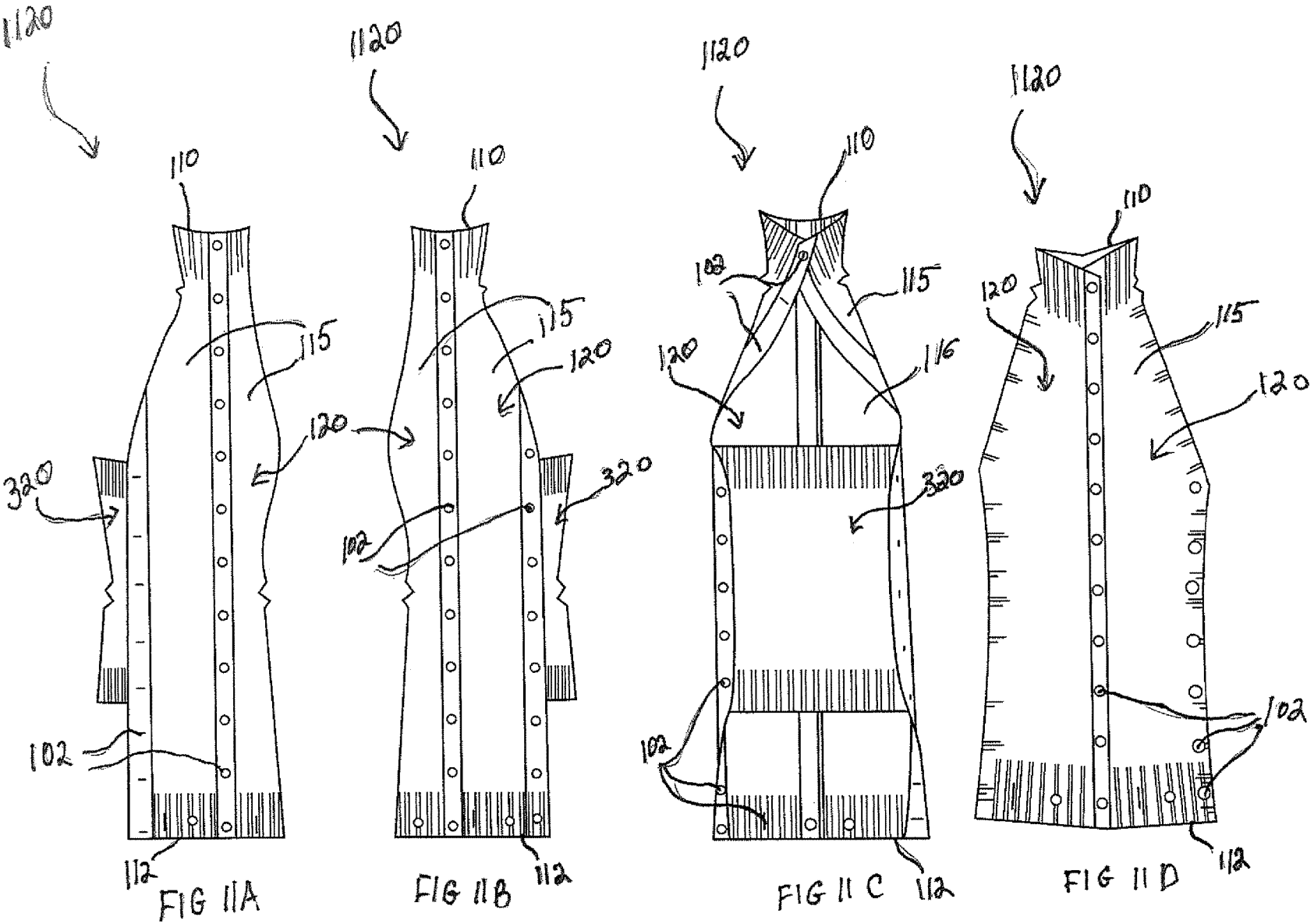
FIG. 11A comprises a right-side view of a combination of customizable sleeves and a third customizable element configured into a top in accordance with an embodiment of the present invention.
FIG. 11B comprise a left-side view of a combination of customizable sleeves and a third customizable element configured into a turtleneck top in accordance with an embodiment of the present invention.
FIG. 11C comprise a rear view of a combination of customizable sleeves and a third customizable element configured into a turtleneck top in accordance with an embodiment of the present invention.
FIG. 11D comprise a front view of a combination of customizable sleeves and a third customizable element configured into a turtleneck top in accordance with an embodiment of the present invention.

In FIGS. 10A-10B another embodiment of the present invention is shown where four detachable customizable sleeves 120 of hybrid wearable apparel are attached to each other via fasteners 102 to form a sleeveless shirt-type or vest-type garment 1020. Each detachable customizable sleeve 120 is attached to two other detachable customizable sleeves 120 via fasteners 102 disposed longitudinally along respective first and second long ends of each detachable customizable sleeve 120, respectively, thus forming the front and back of the garment. Each pair of the four detachable customizable sleeves 120 is attached via engagement of fasteners 120 disposed proximate to a top edge 110 to form portions of the garment 1020 configured to fit over the shoulders of a wearer. The first surfaces 115 of each of the detachable customizable sleeves 120 and the second surfaces 116 of each of the detachable customizable sleeves 120 combine to form the interior and exterior surfaces of the garment 1020 respectively. It should be understood that the embodiment of the present invention comprising modular components such as hybrid apparel detachable customizable sleeves 120 can be transformed into another embodiment of the present invention, by an addition or removal of the modular component. Accordingly vest-type garment 820 representing one embodiment of the present invention can be transformed into shirt-type garment 1020 by an addition of two more detachable customizable sleeves 120. Alternatively, two vest-type garments 820 can be combined to form sleeveless shirt-type garment 1020. The garment 1020 of this embodiment is shown worn by a wearer in FIGS. 20A-20B.

In FIGS. 11A-11D another embodiment of the present invention is shown where two identical detachable customizable sleeves 120 and the third customizable element 320 of hybrid wearable apparel are attached to each other via fasteners 102 to form a garment 1120. Attaching a first end of the third customizable element 320 to a second end of one detachable customizable sleeve 120 and attaching a second end of the third customizable element 320 to a first end of the other detachable customizable sleeve 120 forms the back of garment 1120 via engagement of corresponding fasteners 102 disposed proximate to each respective end. Further, attaching fasteners proximate to the top edge 110 of one detachable customizable sleeve 120 to corresponding fasteners of the other detachable customizable sleeve 120 forms the portion of the garment which forms a turtleneck collar around the neck of the wearer. Engagement of fasteners 102 disposed along the first end of one detachable customizable sleeve 120 to the fasteners 102 disposed along the second end of the other detachable customizable sleeve 120 forms the front of the garment 1120. The first surfaces 115 of each of the detachable customizable sleeves 120 and the second surfaces 116 of each of the detachable customizable sleeves 120 combine to form the interior and exterior surfaces of the garment 1120 respectively. In accordance with this embodiment, through the addition of the third customizable element 320 to the back of the vest-type garment 820, the garment 820 can be transformed into the garment 1120 which can function as a shirt, dress, or blouse. Further, the embodiment represented by garment 920 can be transformed into the embodiment represented by garment 920 by disengaging fasteners 102 disposed along the ends of detachable customizable sleeves 120 forming the tapered neck line and engaging fasteners 102 disposed proximate to top edge 110 to form the turtleneck collar. The garment 1120 of this embodiment is shown worn in conjunction with a pair of detachable sleeves formed from detachable customizable sleeves 120 in FIGS. 19A-19B.

Figure 12A:
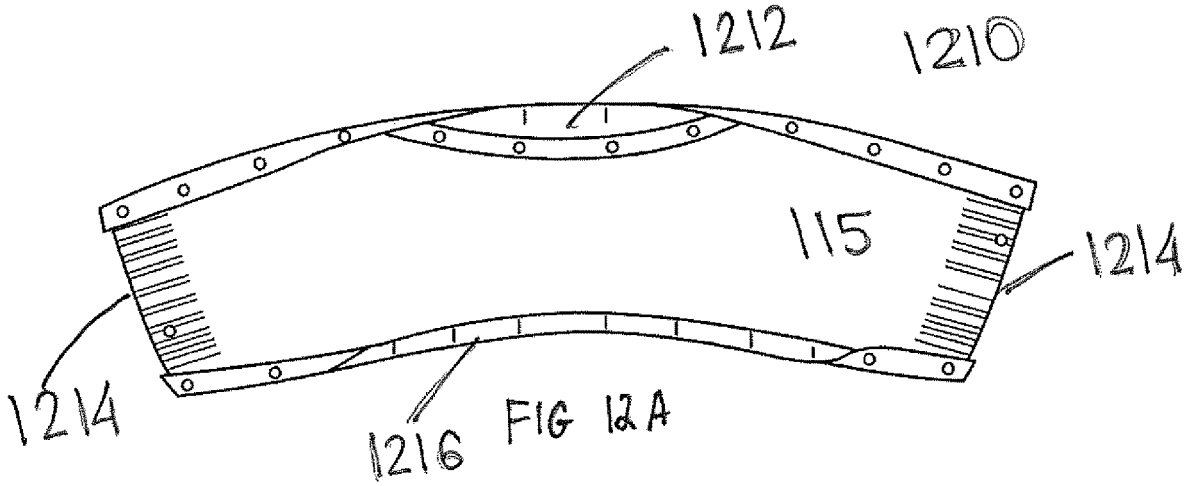
FIG. 12A comprises a front view of a combination of a pair of customizable sleeves/armwear configured into a crop top/short sleeves in accordance with an embodiment of the present invention.
Figure 12B:
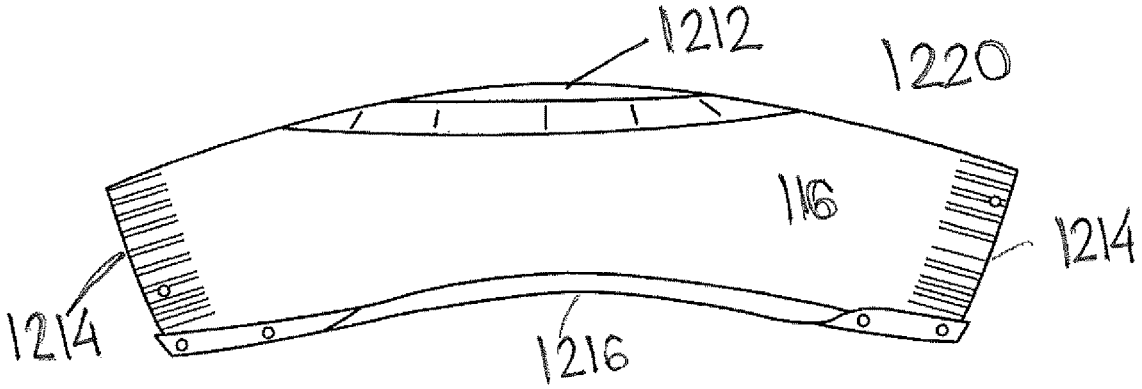
FIG. 12B comprises a rear view of a combination of a pair of customizable sleeves/armwear configured into a crop top/short sleeves in accordance with an embodiment of the present invention.

FIGS. 12A-12D each depicts a pair of detachable customizable sleeves/armwear 120 configured to form short sleeves or shrug-looking garment 1210, 1220, 1230, 1240, generally dimensioned to at least partially cover the shoulders as well as the upper chest and back of a typical wearer. Specifically, FIG. 12A depicts a frontal view 1210 of short sleeves/shrug-top constructed from a pair of detachable customizable sleeves/armwear 120 interconnected by a selective engagement of the fasteners 102 in such a way to form a sleeveless/shrug-top having a plurality of openings defined by the disconnected portions of the pair of detachable customizable sleeves/armwear each respectively adapted to either permit the insertion and removal of a wearer's head or appendages or to secure the sleeveless shrug-top on the body of the wearer. FIG. 12B illustrates a back view 1220 of the same embodiment of the disclosed invention.

Figure 12C:
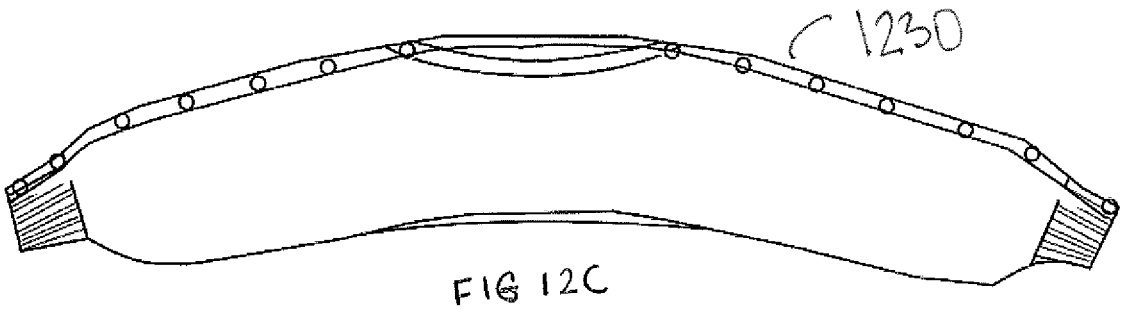
FIG. 12C comprises a front view of a combination of a pair of customizable sleeves configured into a crop top/long sleeves/scarf in accordance with an embodiment of the present invention.
Figure 12D:
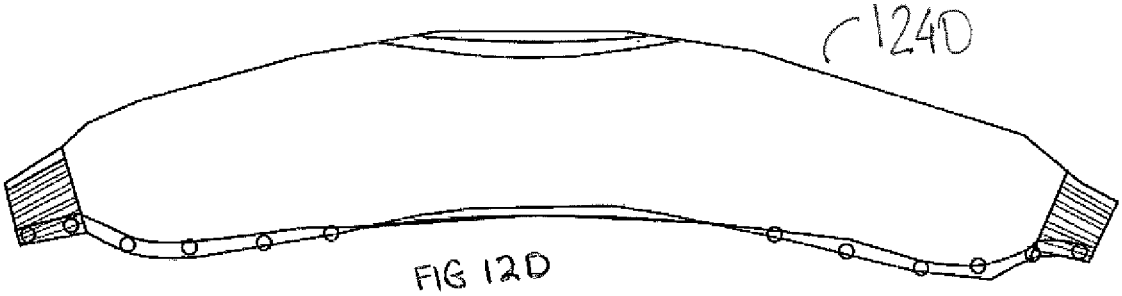
FIG. 12D comprises a rear view of a combination of a pair of customizable sleeves/panels configured into long sleeves/scarf in accordance with an embodiment of the present invention.

FIGS. 12C-12D depict a front and rear views, respectively 1230 and 1240, of a shrug-top/long sleeves constructed using same configuration as shown in FIGS. 12A-12B that can be worn as a scarf and a sash Shrug-top depicted in FIGS. 12A-12D contains adjustable slits in the area of a neckline 1212 sleeves through which a wearer's head can pass to put on the garment; a adjustable hemline cavity 1216 which fits around the upper portion of a wearer's torso to secure the garment thereon, and armholes 1214 through which the arms of a wearer can be inserted.

Figure 13:
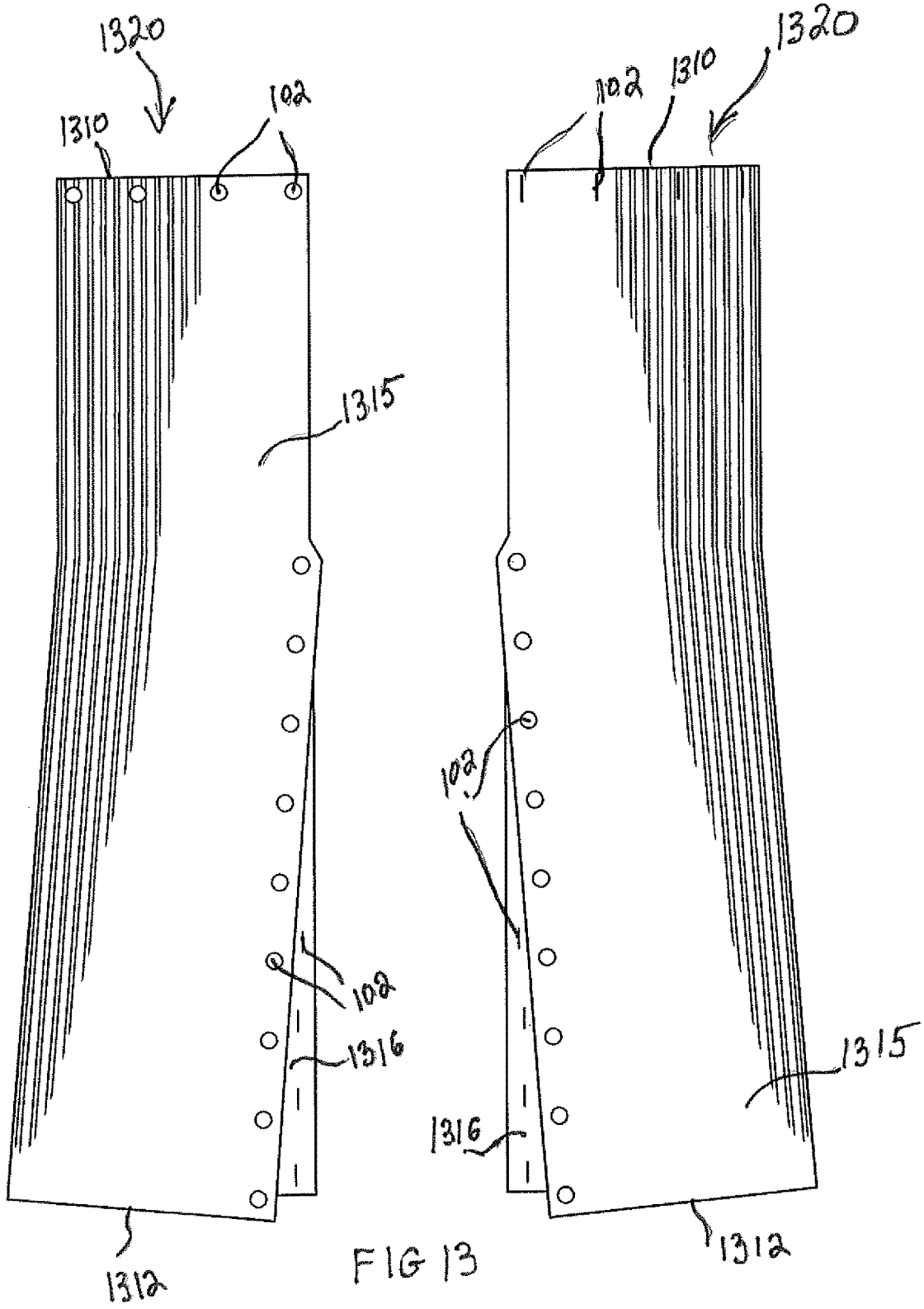
FIG. 13 illustrates two views of customizable sleeves configured into [slitted armwear) in accordance with an embodiment of the present invention.

FIG. 13 depicts pull-on detachable customizable sleeves 1320 in accordance with an embodiment of a present invention which comprises yet another alternative hybrid wearable apparel element 1320. As can be seen in the figure, each element 1320 is formed in a tubular shape with a partially open seam on one side of the element. Each side of the seam is equipped with a plurality of fasteners 102 disposed longitudinally thereon. Further, each element 1320 has a top edge 1310 and a bottom edge 1312 as well as an exterior surface 1315 and an interior surface 1316. While fasteners 102 can be disposed proximate to both the top edge 1310 and the bottom edge 1312, FIG. 13 shows a variation where fasteners are disposed on only the top one of the two edges. The top edges can be easily interconnected and transformed into a scarf-type garment.

Figure 18A:
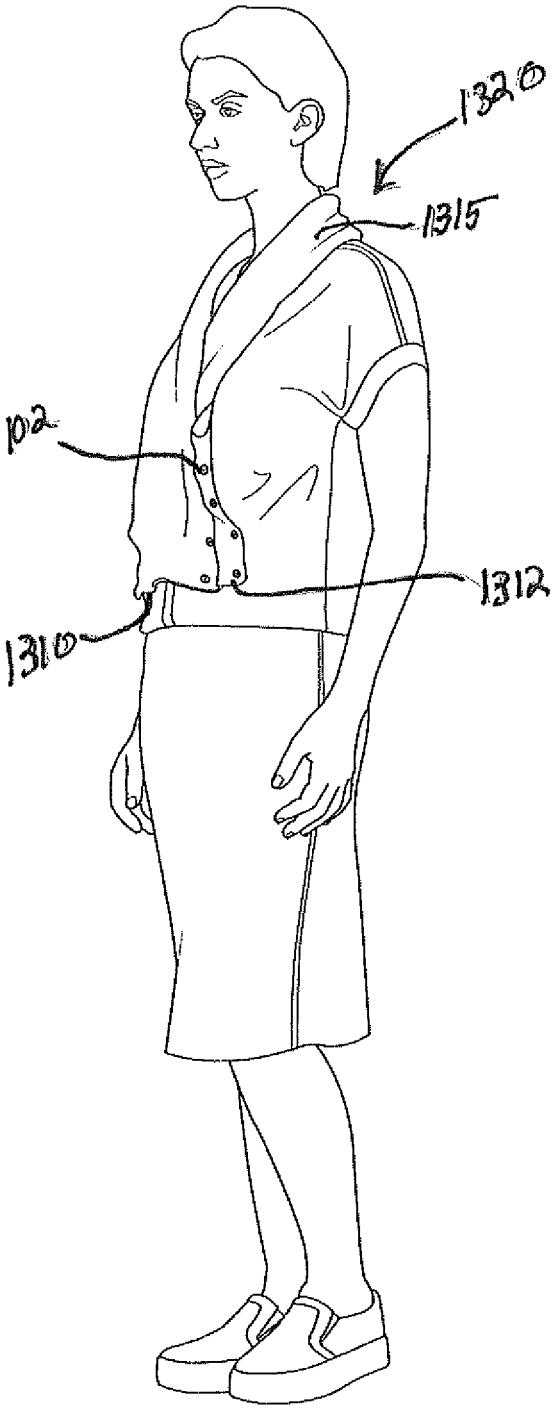
FIG. 18A comprises a perspective view of a customized garment configuration with neckwear being worn by a wearer depicting the transformation of a sleeve into neckwear in accordance with an embodiment of the present invention.
Figure 18B:
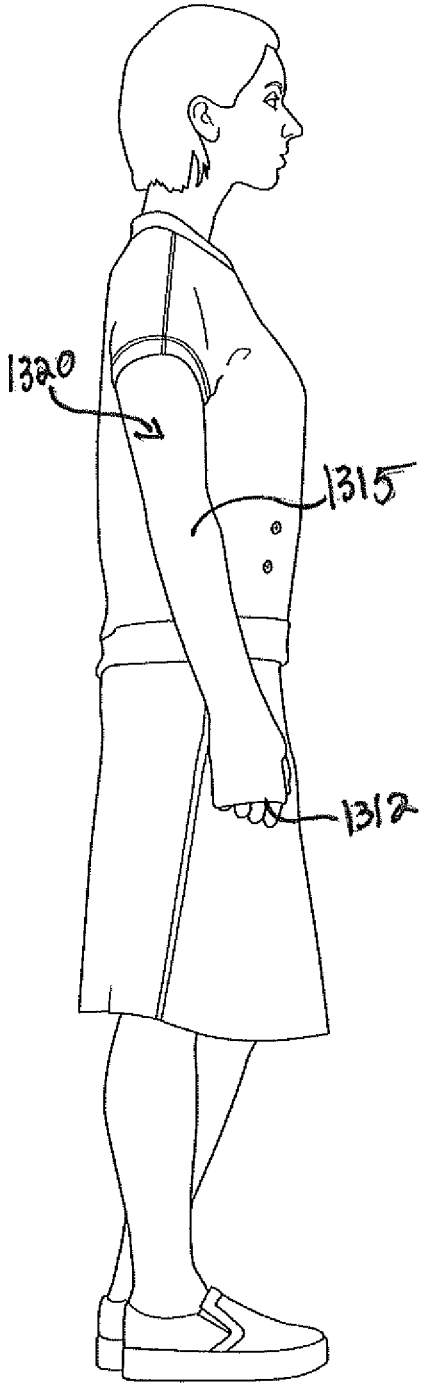
FIG. 18B comprises a side view of a detachable customizable sleeve being worn by a wearer depicting the transformation of neckwear into a sleeve in accordance with an embodiment of the present invention.
Figure 19A:
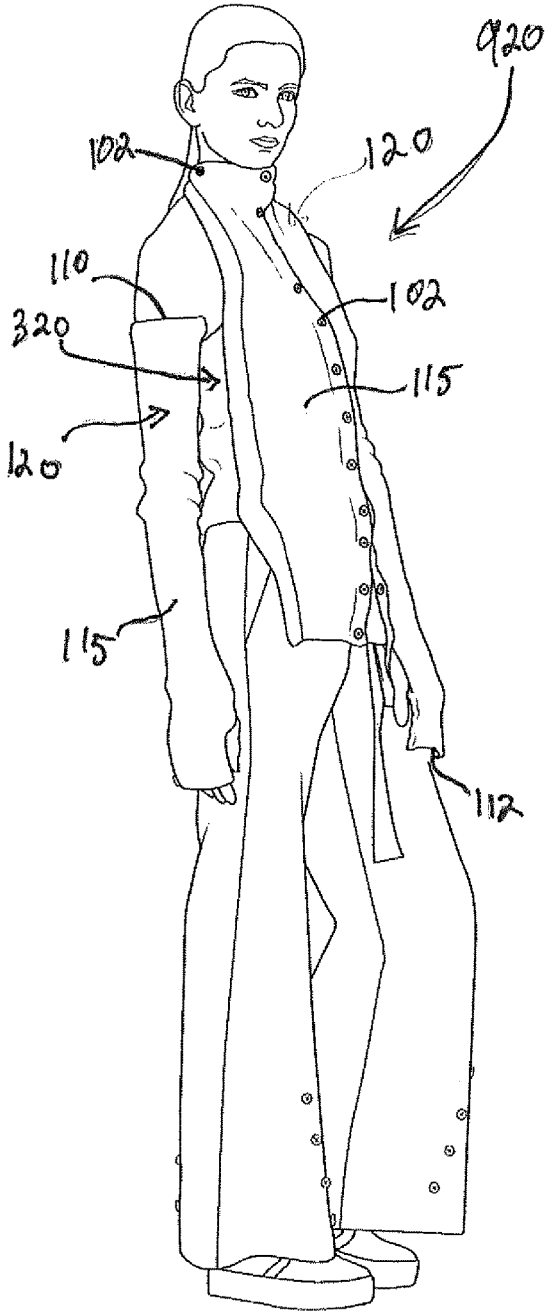
FIG. 19A comprises a perspective view of a low-back top customized garment configuration depicted in FIGS. 9A-9D with the detached sleeves being worn by a wearer in accordance with an embodiment of the present invention.
Figure 19B:
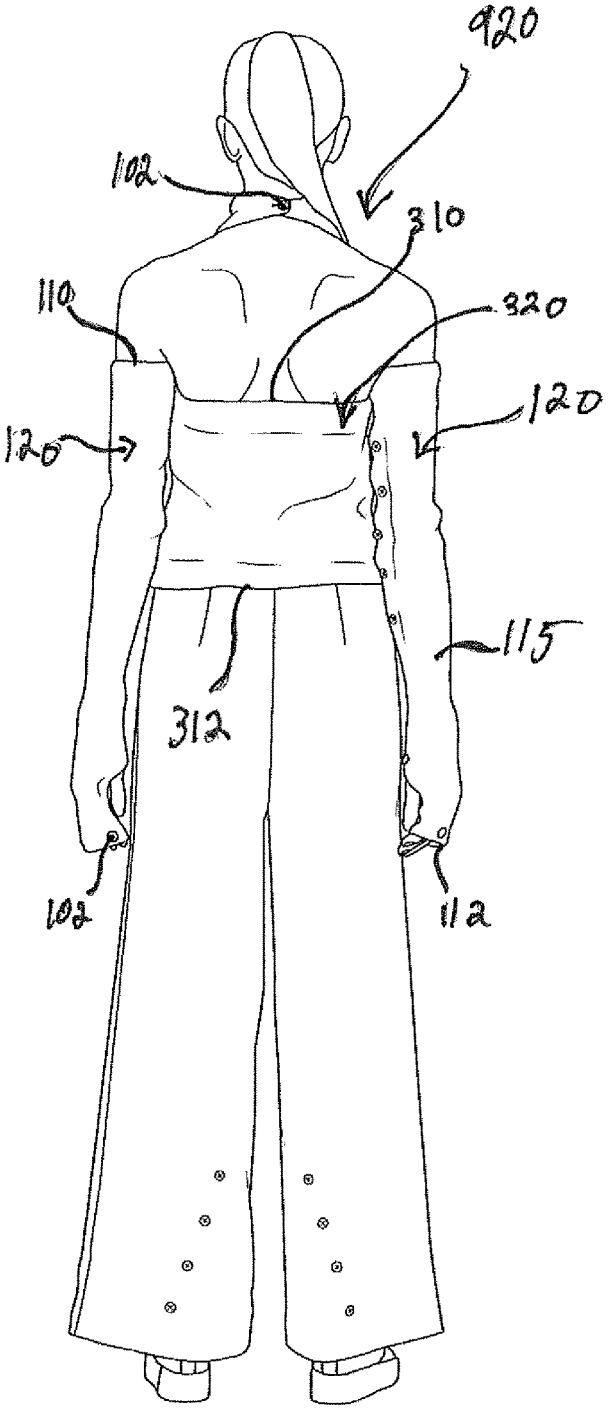
FIG. 19B comprises a rear view of a low-back top customized garment configuration depicted in FIGS. 9A-9D with the detached sleeves being worn by a wearer in accordance with an embodiment of the present invention.
Figures 20A, 20B:
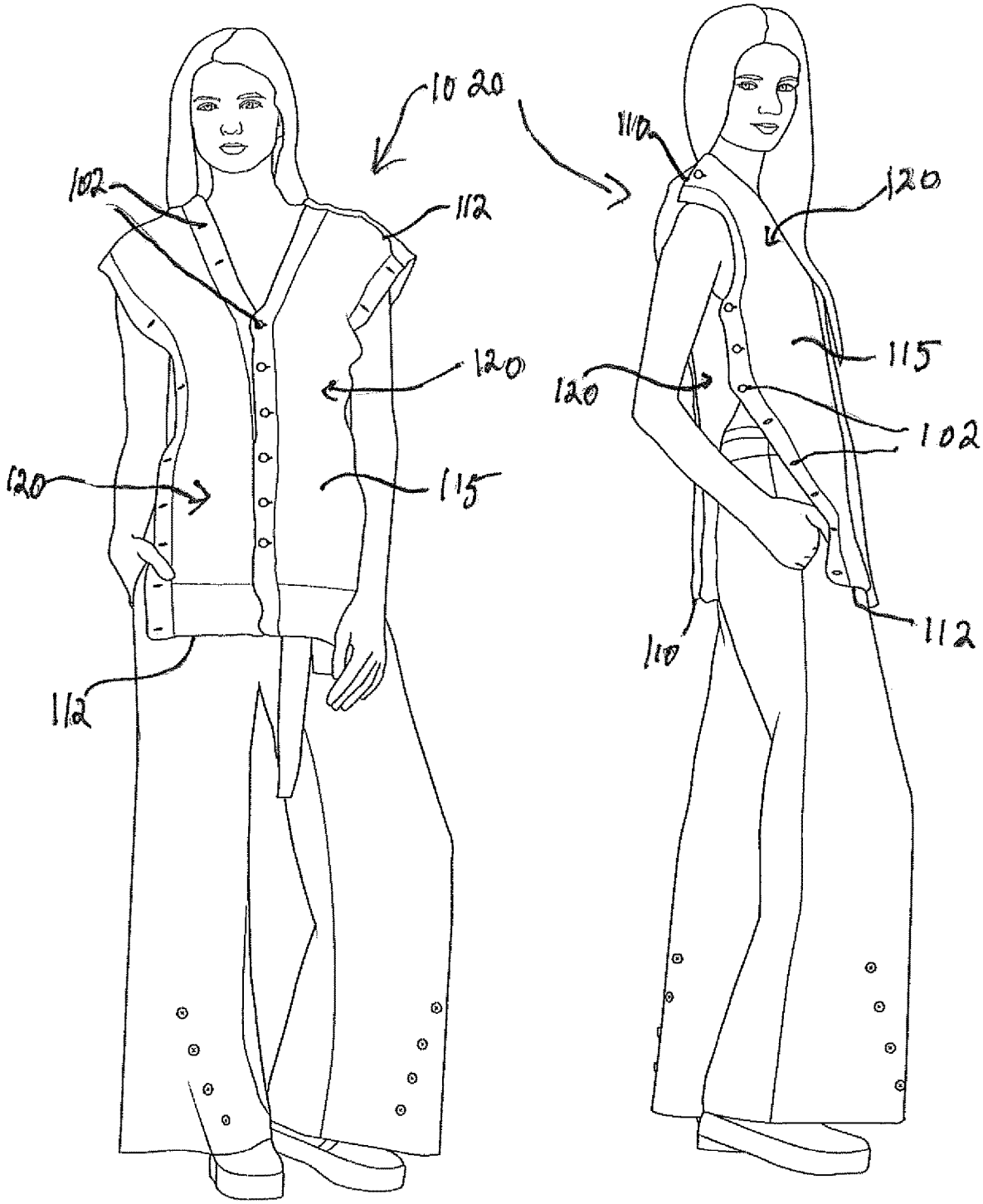
FIG. 20A comprises a front view of a sleeveless top customized garment configuration depicted in FIGS. 10A-10B being worn by a wearer in accordance with an embodiment of the present invention.
FIG. 20B comprises a side view of a sleeveless top customized garment configuration depicted in FIGS. 10A-10B being worn by a wearer in accordance with an embodiment of the present invention.

Similarly, FIGS. 18A-18B show how a hybrid wearable apparel 1320 can be transformed from functioning as a scarf to functioning as a detachable sleeve apparel. It should be understood that two detachable customizable sleeves 120 that are combined into a scarf-type garment 520 typically worn in the manner depicted in FIG. 18A, can analogously be detached and reconfigured into detachable sleeves typically worn connected to another garment as depicted in FIG. 18B.

Figure 14A:
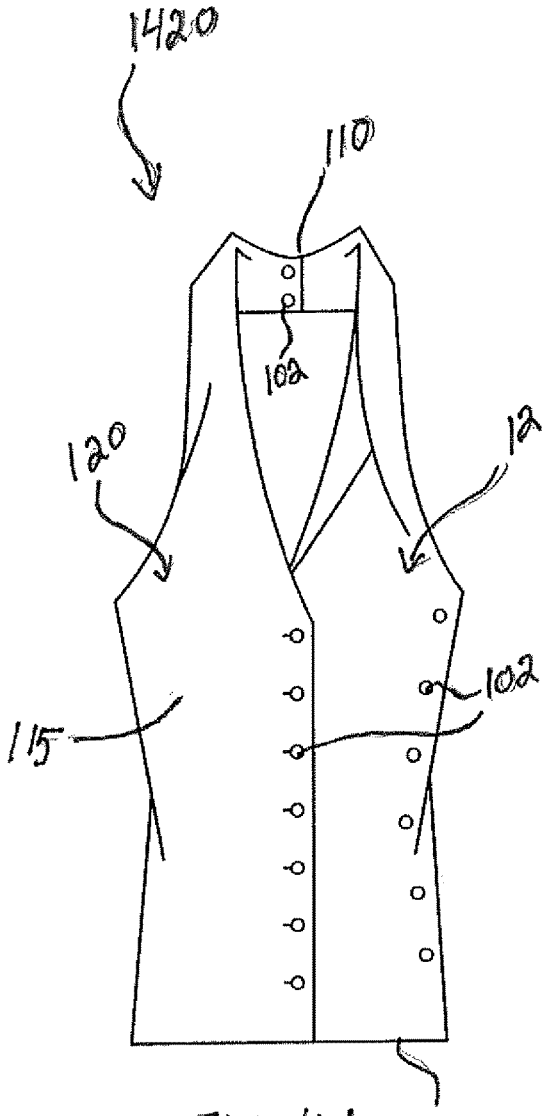
FIG. 14A comprises a front view of a halter top of customizable sleeves/armwear and a third customizable element configured into a low-back top in accordance with an embodiment of the present invention.
Figure 14B:
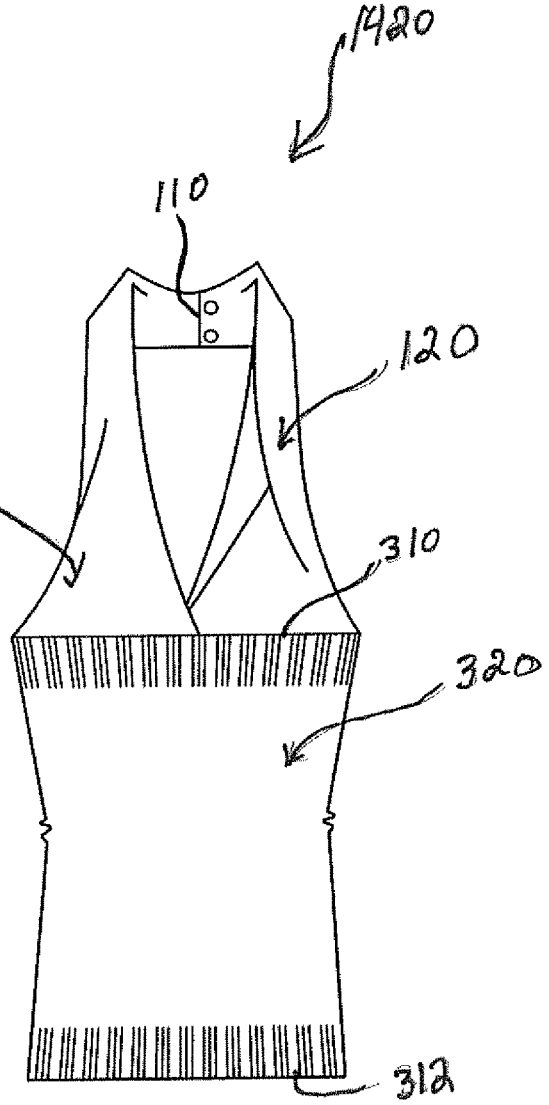
FIG. 14B comprises a rear view of a halter top of customizable sleeves/armwear and a third customizable element configured into a low-back top in accordance with an embodiment of the present invention.
Figure 17A:
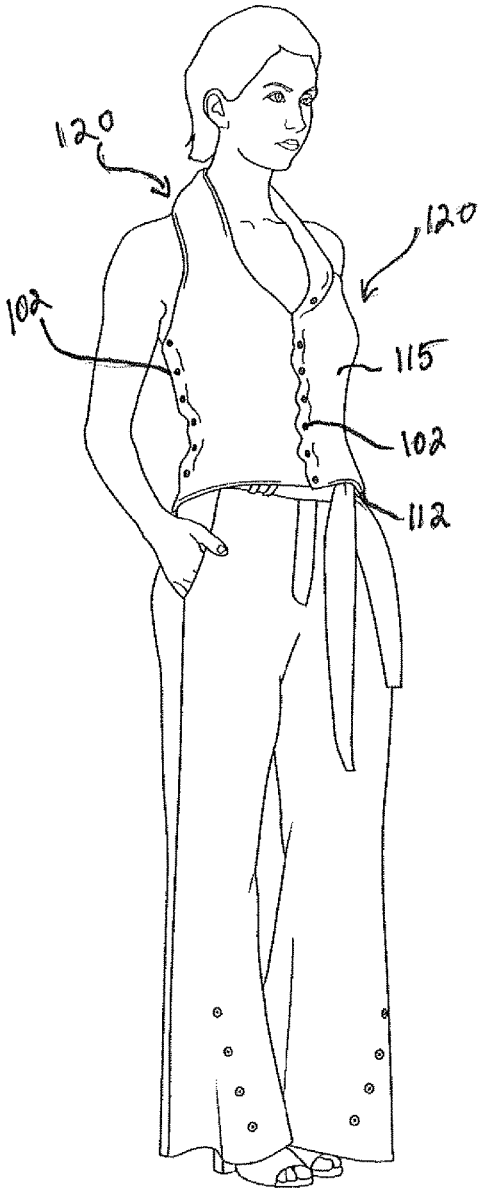
FIG. 17A comprises a perspective front view of a combination of a pair of customizable sleeves and a third customizable element configured into the low-back top embodiment shown in FIGS. 9A-9D being worn by a wearer in accordance with an embodiment of the present invention.
Figure 17B:
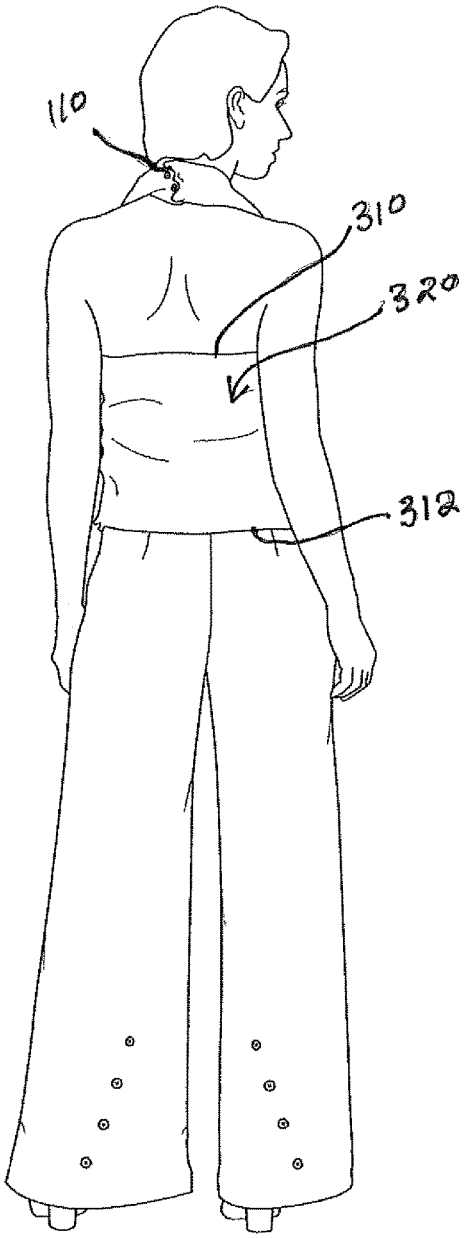
FIG. 17B comprises a perspective rear view of a combination of a pair of customizable sleeves and a third customizable element configured into the low-back top embodiment shown in FIGS. 9A-9D being worn by a wearer in accordance with an embodiment of the present invention.

In FIGS. 14A-14B another embodiment of the present invention is shown where two identical detachable customizable sleeves 120 and the third customizable element 320 of hybrid wearable apparel are attached to each other via fasteners 102 to form a halter-top type garment 1420. Attaching a first end of third customizable element 320 to a second end of one detachable customizable sleeve 120 and attaching a second end of the third customizable element 320 to a first end of the other detachable customizable sleeve 120 forms the back of garment 1420 via engagement of corresponding fasteners 102 disposed proximate to each respective end. Further, folding the first end of the top portion toward the second end of the top portion of each detachable customizable sleeve 120 and also attaching fasteners 102 proximate to the top edge 110 of detachable customizable sleeve 120 to corresponding fasteners of the other detachable customizable sleeve 120 forms the halter-neck strap of the garment 1420. Engagement of fasteners 102 disposed along the first end of one detachable customizable sleeve 120 to the fasteners 102 disposed along the second end of the other detachable customizable sleeve 120 forms the front of the garment 920. It should be understood that, according to this embodiment of the present invention, through the addition of the third customizable element 320 to the back of the vest-type garment 820, the garment 820 can be transformed into a garment 1420 which can function as a halter-top. The way a wearer would typically wear halter-top type garment 1420 is depicted in FIGS. 17A-17B.

Figure 15:
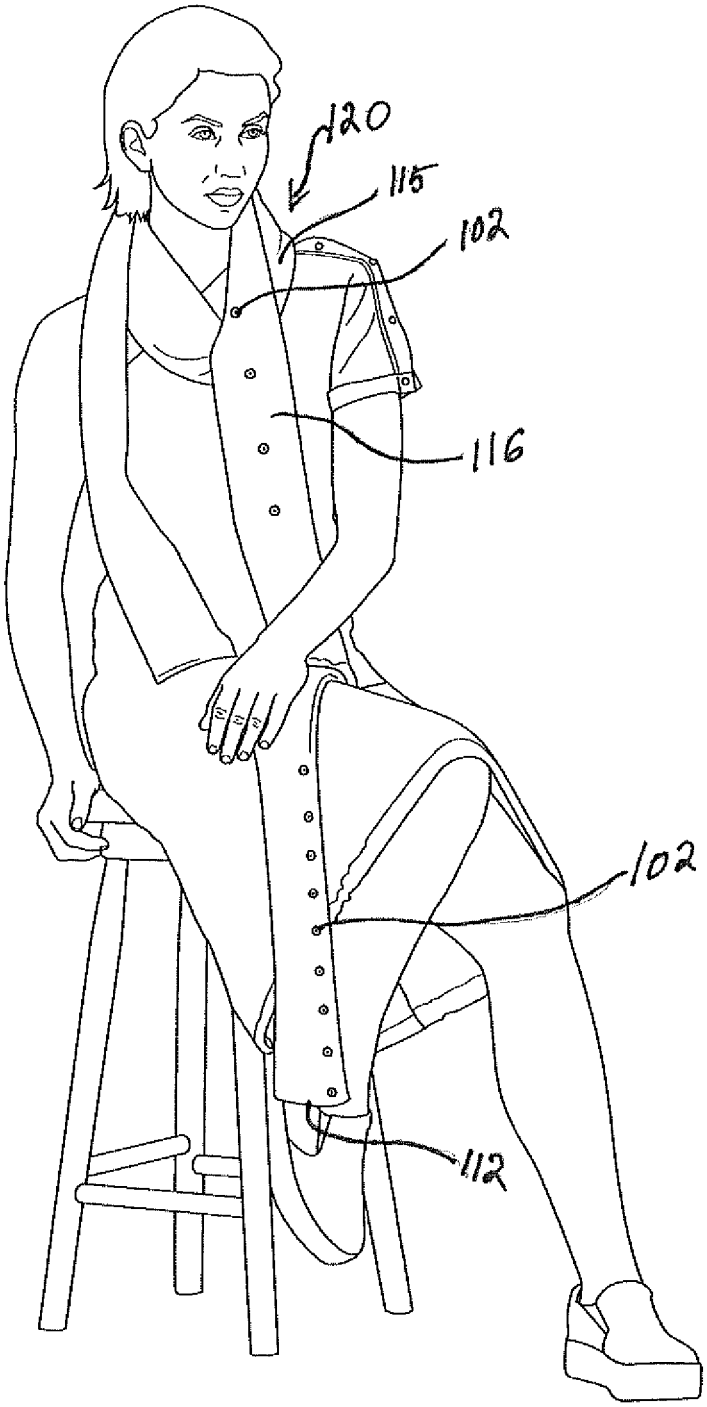
FIG. 15 is a perspective view illustrating an embodiment of the present invention being worn by a wearer.

An embodiment of the present invention comprised of a plurality of detachable customizable sleeves 120 presented in tubular or rectangular configurations connected to each other via the third and fourth sets of fasteners 102 described above to form a scarf garment 520 can be seen being worn in FIG. 15. Although the combination of only two detachable customizable sleeves 120 via third set of fasteners 102 and fourth set of fasteners 102, it should be understood by one skilled in the art that the process of attaching additional detachable customizable sleeves 102 can be iteratively repeated to vary the length of the resulting scarf garment 520.

Figure 16A:
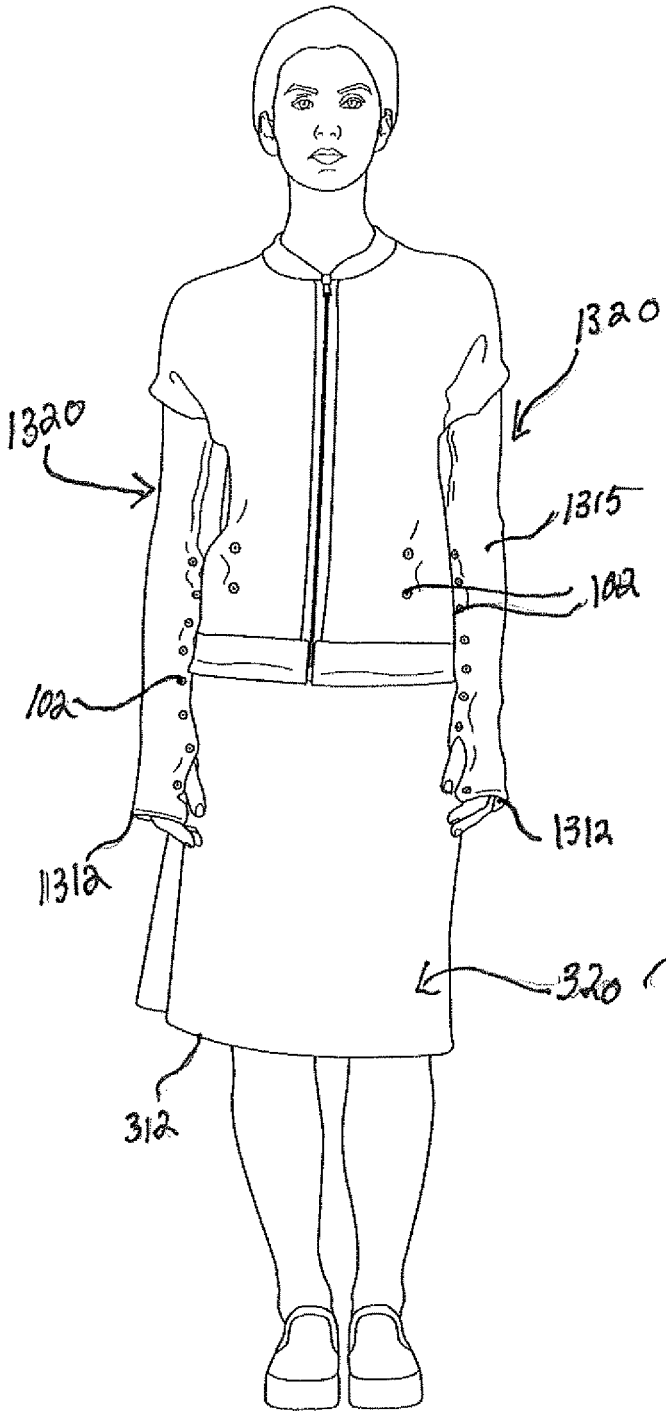
FIG. 16A comprises a front view of customizable sleeves being worn by a wearer in accordance with an embodiment of the present invention.
Figure 16B:
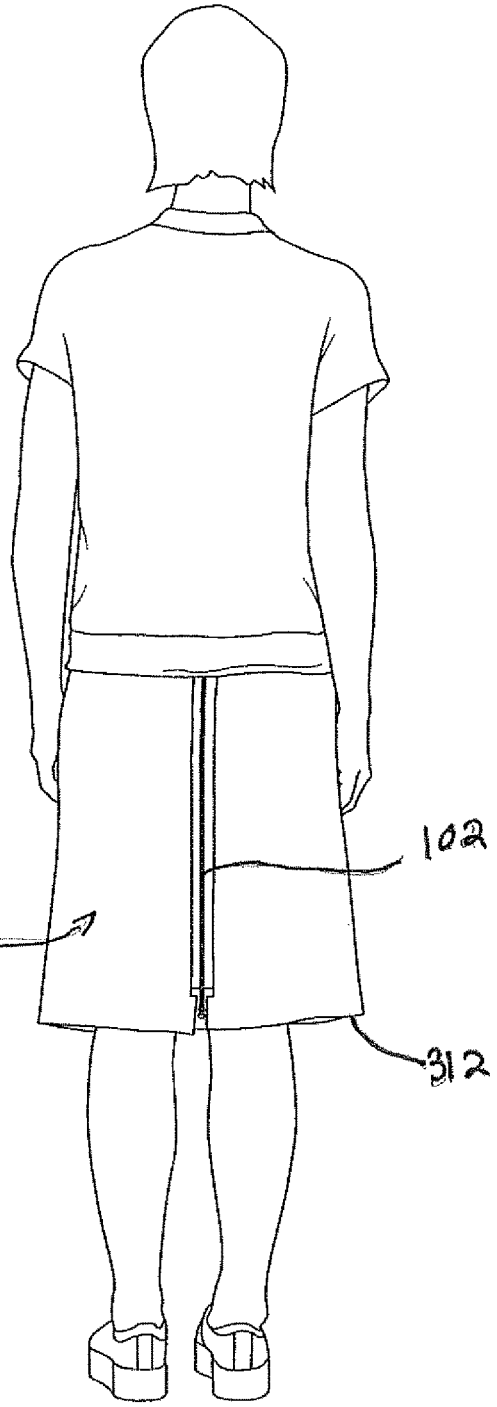
FIG. 16B comprises a rear view of customizable sleeves being worn by a wearer in accordance with an embodiment of the present invention.

In accordance with an embodiment of a present invention a detachable customizable sleeve garment 1320 is depicted being worn connected to a short-sleeve garment in FIG. 16A. FIG. 16B depicts the garment variant with the customizable sleeves detached. Both figures also show a skirt-type garment comprised of the third customizable element 320. In this embodiment, the skirt garment element 320 is formed into a substantially cylindrical shaped as described above and comprises zipper fasteners 102 disposed along its ends. It should be understood by one skilled in the art that detachable customizable sleeves 120 in tubular or substantially rectangular configurations, as described above, can serve as a replacement to detachable sleeve garment 1320 in this embodiment of the present invention.

Figure 21A:
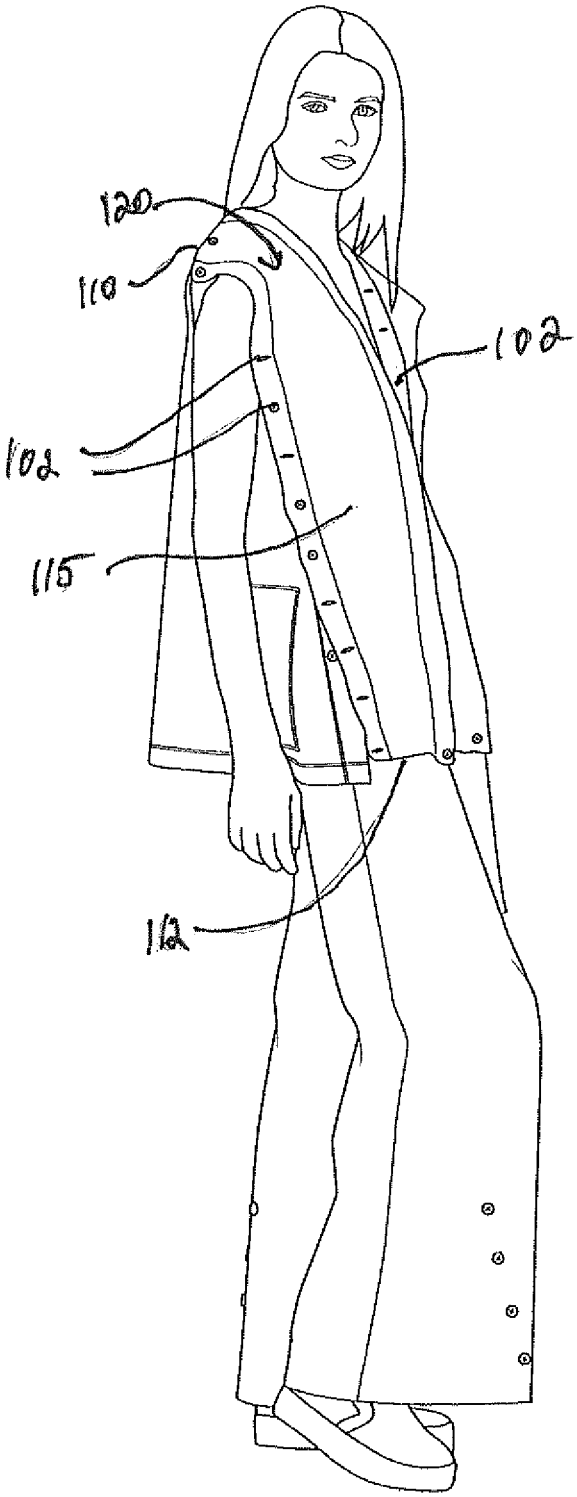
FIG. 21A comprises a perspective view of a customized garment configuration being worn by a wearer in accordance with an embodiment of the present invention.
Figure 21B:
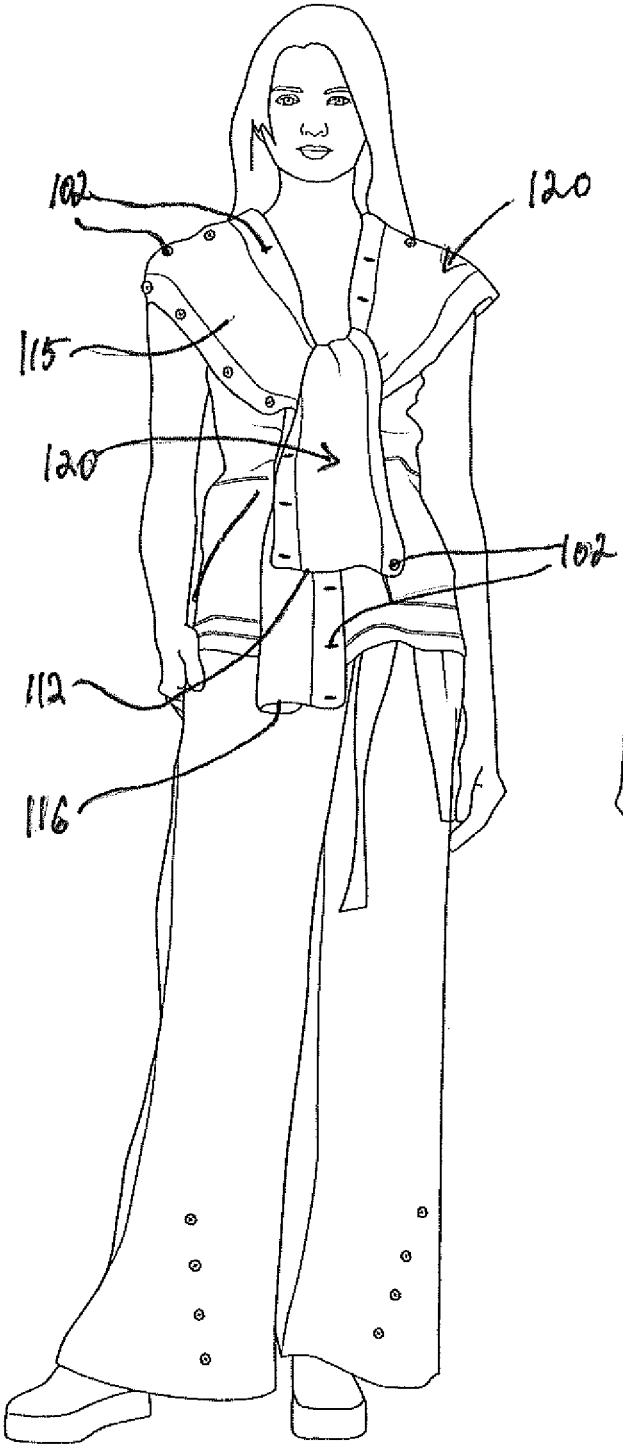
FIG. 21B comprises a front view of a customized garment configuration being worn by a wearer in accordance with an embodiment of the present invention where the wearable apparel elements at the front of the garment shown in FIG. 22A are tied together to form loose hanging neckwear worn by the wearer in FIG. 22B.
Figure 21C:
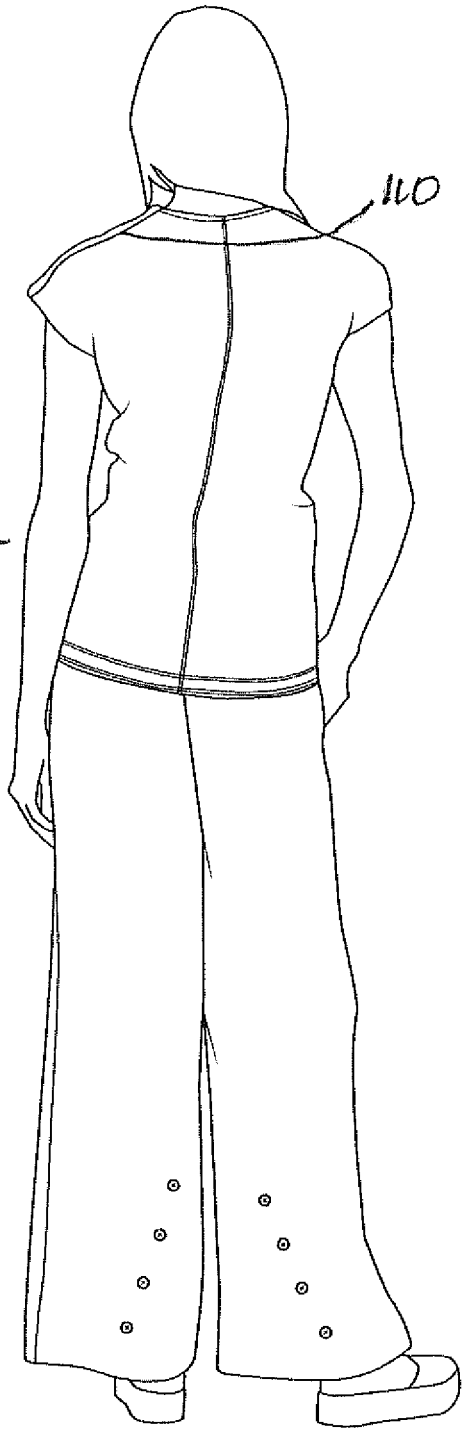
FIG. 21C comprises a rear view of a customized garment configuration being worn by a wearer in accordance with an embodiment of the present invention.
Figure 22:
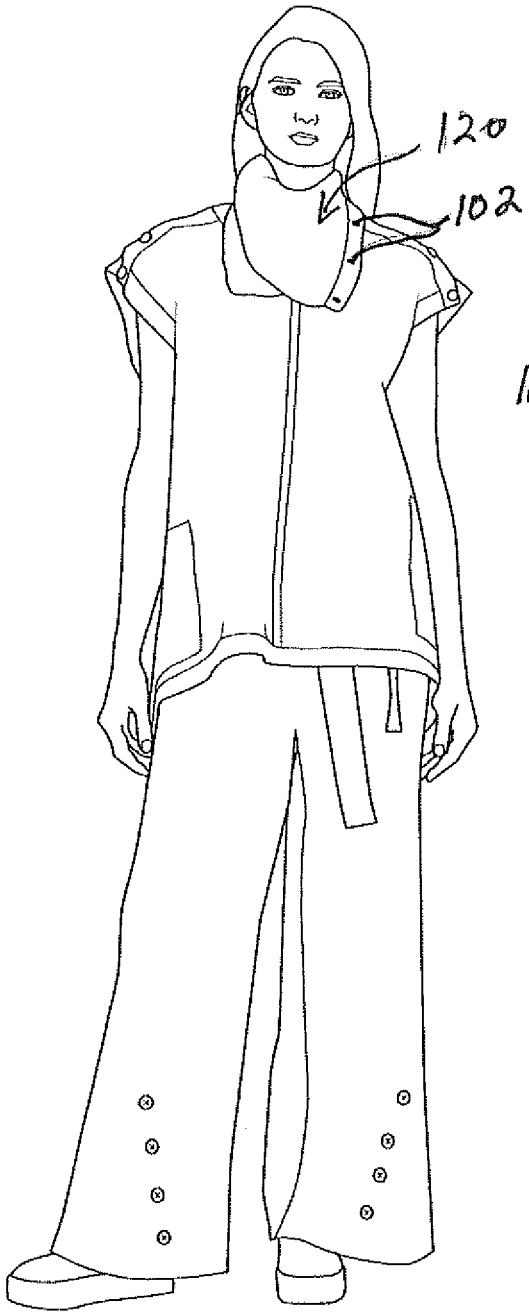
FIG. 22 comprises a front view of a customized garment configuration with neckwear being worn by a wearer in accordance with an embodiment of the present invention.
Figure 23:
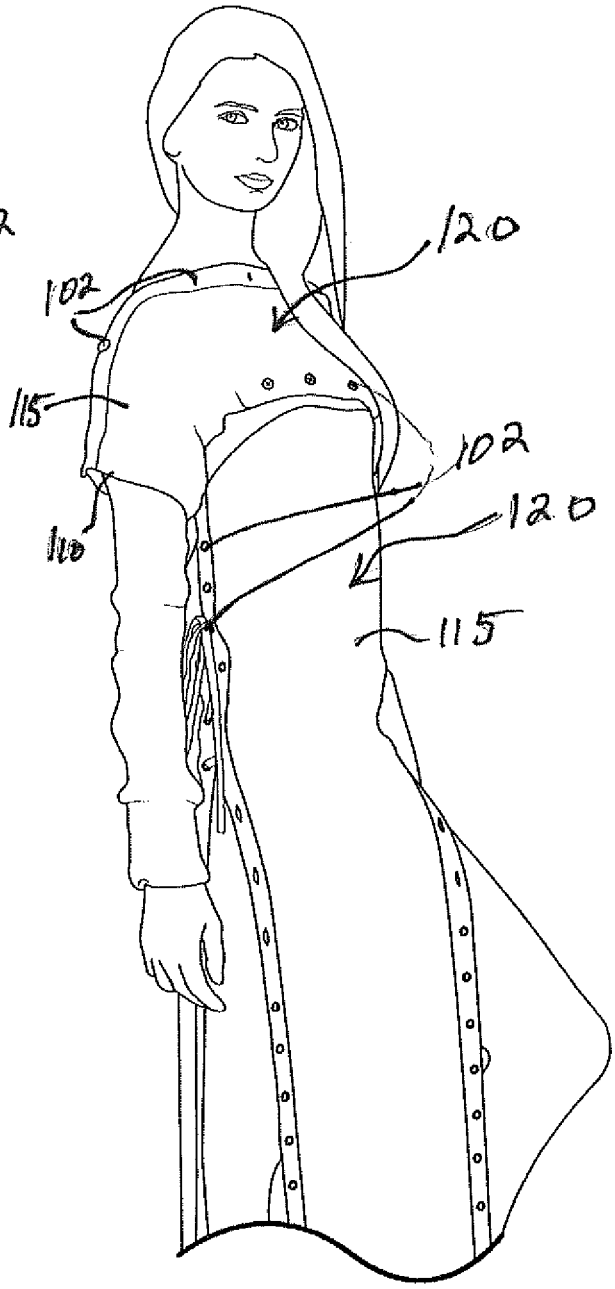
FIG. 23 comprises a side view of an alternative customized garment configuration being worn by a wearer in accordance with an embodiment of the present invention.

FIGS. 21A-21C depict how a detachable sleeve hybrid apparel embodiment of the present invention comprising two detachable customizable sleeves 120 can be attached to another garment. FIG. 21A shows the detachable customizable sleeves 120 connected via fasteners 102 disposed proximate to their respective top edges 110 to corresponding fasteners located on the shoulder areas of the other garment. FIG. 21B shows a reconfiguration of the hybrid apparel embodiment transformed to resemble a shawl or a pashmina in its manner of being worn. FIG. 21C shows a rear view the detachable sleeve hybrid apparel.

FIGS. 22-26 depict various combinations of elements of hybrid apparel in accordance with an embodiment of the present invention, including a sleeveless top with detachable sleeves, neckwear, dress, and a shrug-top.

It is to be understood that fasteners 102 can be buttons, snaps, clips, laces, Velcro, zippers, strips of hook-and-loop material, and the like. It should be noted that other fasteners or fasteners 102 may be used without departing from the spirit of the invention as all the embodiments of the present invention are contemplated to function with any suitable fasteners.

Any element in a claim that does not explicitly state "means for" performing a specified function, or "step for" performing a specific function, is not to be interpreted as a "means" or "step" clause as specified in 35 U.S.C § 112, ¶6. In particular, the use of "step of" in the claims herein is not intended to invoke the provisions of 35 U.S.C § 112, ¶6.

While multiple embodiments are disclosed and the foregoing description includes details which will enable those skilled in the art to practice the invention, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive. They are not exhaustive and do not limit the claimed inventions to the precise forms disclosed. The claims and their equivalents define the scope of the invention.

What is claimed is:

1. A multipurpose customizable garment comprising:

a first detachable element having a first plurality of fasteners;

a second detachable element having a second plurality of fasteners, wherein the first detachable element is a first detachable sleeve, the second detachable element is a second detachable sleeve, wherein at least one of the first detachable sleeve and the second detachable sleeve is convertible into a second multipurpose customizable garment, by detachably connecting the first detachable sleeve to the second detachable sleeve selectively using at least one of the first plurality of fasteners and the second plurality of fasteners such that: (a) each of at least one end of the first detachable sleeve and of at least one end of the second detachable sleeve serves as a neckline of the second multipurpose customizable garment, (b) each of at least one other end of the first detachable sleeve and of at least one other end of the second detachable sleeve serves as hem of the second multipurpose customizable garment, (c) each of at least one top edge of the first detachable sleeve and of at least one top edge of the second detachable sleeve serves as a first sleeve of the second multipurpose customizable garment, and (d) each of at least one bottom edge of the first detachable sleeve and of at least one bottom edge of the second detachable sleeve serves as a second sleeve of the second multipurpose customizable garment.

2. The multipurpose customizable garment of claim 1, further comprising a third detachable element having a third plurality of fasteners.

3. The multipurpose customizable garment of claim 2, wherein each of the first detachable sleeve, the second detachable sleeve, and the third detachable element has essentially rectangular configuration.

4. The multipurpose customizable garment of claim 2, wherein the third detachable element is convertible into a second multipurpose customizable garment by selectively interconnecting the third plurality of fasteners.

5. The multipurpose customizable garment of claim 2, wherein the first detachable sleeve, the second detachable sleeve, and the third detachable element are convertible into a third multipurpose customizable garment by detachably connecting the first detachable sleeve, the second detachable sleeve, and the third detachable element selectively using at least one of the first plurality of fasteners, the second plurality of fasteners, and the third plurality of fasteners.

6. The multipurpose customizable garment of claim 1, wherein the second multipurpose customizable garment is one of:

a neck-wear;
a belt;
a vest;
a shrug-top;
a head-band; and
a low-back top/halter top.

7. The multipurpose customizable garment of claim 5, wherein the third multipurpose customizable garment is one of:

a sleeveless blouse;
a low-back top/halter top; and
turtleneck top.

8. A method of converting a first multipurpose customizable garment into a second multipurpose customizable garment, the method comprising:

detaching from the first multipurpose customizable garment a first detachable sleeve having a first plurality of fasteners;

detaching from the first multipurpose customizable garment a second detachable sleeve having a second plurality of fasteners; and constructing the second multipurpose customizable garment by detachably connecting the first detachable sleeve to the second detachable sleeve selectively using at least one of the first plurality of fasteners and the second plurality of fasteners such that: (a) each of at least one end of the first detachable sleeve and of at least one end of the second detachable sleeve serves as a neckline of the second multipurpose customizable garment, (b) each of at least one other end of the first detachable sleeve and of at least one other end of the second detachable sleeve serves as hem of the second multipurpose customizable garment, (c) each of at least one top edge of the first detachable sleeve and of at least one top edge of the second detachable sleeve serves as a first sleeve of the second multipurpose customizable garment, and (d) each of at least one bottom edge of the first detachable sleeve and of at least one bottom edge of the second detachable sleeve serves as a second sleeve of the second multipurpose customizable garment.

9. The method of claim 8, wherein the second multipurpose customizable garment is a shrug-top.

10. The method of claim 8, further comprising:

constructing a third multipurpose customizable garment by detachably interconnecting the first detachable sleeve, the second detachable sleeve, and a third detachable element having a third plurality of fasteners.

11. The method of claim 8, wherein detachably interconnecting the first detachable sleeve, the second detachable sleeve, and a third detachable element comprises detachably selectively interconnecting the first plurality of fasteners of the first detachable sleeve, the second plurality of fasteners of the second detachable sleeve, and the third plurality of fasteners of the third detachable element.

12. The method of claim 10, wherein the third multipurpose customizable garment is a sleeveless blouse.

13. The method of claim 10, wherein the third multipurpose customizable garment is a low-back top.

14. The method of claim 10, wherein the third multipurpose customizable garment is a halter top.

15. The method of claim 10, wherein the third multipurpose customizable garment is a turtleneck top.

16. The method of claim 10, wherein the third multipurpose customizable garment is a backless top.

* * * * *